US012414619B2

(12) United States Patent
Chung et al.

(10) Patent No.: US 12,414,619 B2
(45) Date of Patent: Sep. 16, 2025

(54) ECO COSMETIC CONTAINER

(71) Applicant: CTK CO., LTD., Seoul (KR)

(72) Inventors: In Yong Chung, Seoul (KR); Won Eui Lee, Seoul (KR); In Young Um, Seoul (KR); Myung Joong Kim, Pocheon-si (KR); Kyung Ho Kang, Suwon-si (KR); Minji Oh, Seoul (KR); Ji Yong Lee, Seoul (KR)

(73) Assignee: CTK CO., LTD., Seoul (KR)

( * ) Notice: Subject to any disclaimer, the term of this patent is extended or adjusted under 35 U.S.C. 154(b) by 53 days.

(21) Appl. No.: 18/083,471

(22) Filed: Dec. 16, 2022

(65) Prior Publication Data

US 2024/0057744 A1 Feb. 22, 2024

(30) Foreign Application Priority Data

Aug. 22, 2022 (KR) ..... 10-2022-0104919

(51) Int. Cl.

*A45D 40/22* (2006.01)
*A45D 33/00* (2006.01)
*A45D 40/00* (2006.01)

(52) U.S. Cl.

CPC ..... *A45D 40/222* (2013.01); *A45D 33/008* (2013.01); *A45D 2040/0012* (2013.01)

(58) Field of Classification Search

CPC ..... A45D 33/22; A45D 33/24; A45D 33/006; A45D 33/008; A45D 40/22; A45D 40/222
See application file for complete search history.

(56) References Cited

U.S. PATENT DOCUMENTS

2007/0006995 A1* 1/2007 Lin ..... F28D 15/02 165/104.21
2017/0295905 A1* 10/2017 Kim ..... B65D 47/065
2018/0177277 A1* 6/2018 Dinata ..... B65D 41/04
2019/0365074 A1* 12/2019 Kikuchi ..... A45D 33/006
(Continued)

FOREIGN PATENT DOCUMENTS

KR 200362370 * 9/2004
KR 200429553 Y1 * 7/2006 ..... A45D 33/00
KR 200429553 * 10/2006
(Continued)

OTHER PUBLICATIONS

Machine Translation for Yeo reference (Year: 2020).*
(Continued)

*Primary Examiner* — Eric J Rosen
*Assistant Examiner* — Sydney J Pulvidente
(74) *Attorney, Agent, or Firm* — Bridgeway IP Law Group, PLLC; Jihun Kim

(57) ABSTRACT

Provided is an eco-friendly cosmetic container including: a lower container having a cosmetic material accommodation dish seating portion; an upper container open and closed with respect to the lower container by means of a hinge coupling structure; a cosmetic material accommodation dish seated onto the cosmetic material accommodation dish seating portion; and an intermediate support adapted to be rotatingly locked onto the lower container and released from the locked state over a given region thereof onto and from the lower container to separably fix the cosmetic material accommodation dish to the lower container.

17 Claims, 20 Drawing Sheets

(56) References Cited

U.S. PATENT DOCUMENTS

2021/0330055 A1* 10/2021 Lee ..... A45D 42/04

FOREIGN PATENT DOCUMENTS

| | | | | |
|---|---|---|---|---|
| KR | 10-1584512 | B1 | | 1/2016 |
| KR | 20160040012 | | * | 4/2016 |
| KR | 10-2019-0077675 | A | | 7/2019 |
| KR | 20200093217 | | * | 8/2020 |
| KR | 10-2164415 | B1 | | 10/2020 |
| KR | 10-2021-0050865 | A | | 5/2021 |
| KR | 10-2404259 | B1 | | 6/2022 |
| WO | WO 2014084479 | | * | 6/2014 |

OTHER PUBLICATIONS

Machine Translation for Hong reference (Year: 2006).*
Machine Translation for Choi reference (Year: 2016).*
Hong, KR200429553 description, 2004 (Year: 2004).*

* cited by examiner

ECO COSMETIC CONTAINER

CROSS-REFERENCE TO RELATED APPLICATION

This application claims priority under 35 USC 119 to Korean patent application No. 10-2022-0104919 filed on Aug. 22, 2022, the entire contents of which is incorporated by reference herein.

BACKGROUND OF THE INVENTION

Field of the Invention

The present invention relates to an eco-friendly cosmetic container, and more specifically, to an eco-friendly cosmetic container that is capable of separately discharging a cosmetic material accommodation dish or a mirror therefrom very quickly and easily.

Background of the Related Art

Many tries for environmental protection from various problems, such as global warming, and the like have been made in the fields of developing all kinds of products including cosmetic containers. Recycle, reuse, and easy separation and discharge of products are very important in product development, and further, the demands for eco-friendly products capable of providing environmental protection effectiveness are consistently increasing.

In spite of such trends, however, conventional cosmetic containers are configured to have cosmetic material accommodation dishes separately discharged after cosmetic materials stored therein are used up or mirrors firmly fixed thereto by means of a double-sided tape, a hot-melt adhesive, or an adhesive, so that it is very hard to separately discharge the cosmetic material accommodation dishes and the mirrors, thereby causing many problems in their separation and discharge.

Because of the above-mentioned problems, the conventional cosmetic containers have low recycling and reusing rates and require additional labors and time for their separation and discharge to thus have uneconomical problems, so that they are not eco-friendly, which causes a consumer's ignorance.

So as to solve such problems, a new cosmetic container is disclosed in Korean Patent No. KR10-1584512 (issued on Jan. 25, 2016) entitled "Cosmetic container having refill container provided with sealing ring", in which the refill container made of a metal material with a low thickness is fixed to a refill container holder and a mirror is disposed inside an outer container cap. However, the refill container holder is first separated from an outer container, and next, the refill container made of the metal material is additionally separated from the outer container, so that it is very inconvenient to separate the refill container from the outer container. In specific, the mirror does not have any separation structure. Accordingly, the conventional cosmetic container has structural limitations in separating and discharging the refill container or the mirror.

SUMMARY OF THE INVENTION

Accordingly, the present invention has been made in view of the above-mentioned problems occurring in the related art, and it is an object of the present invention to provide an eco-friendly cosmetic container that is capable of allowing a cosmetic material accommodation dish seated onto a lower container to be separable from the lower container by means of the rotation of an intermediate support, so that after a cosmetic material has been used up, the cosmetic material accommodation dish is replaced with a refill dish or separately discharged very simply, quickly, and conveniently.

It is another object of the present invention to provide an eco-friendly cosmetic container that is capable of allowing a mirror disposed inside an upper container to be fixed to a cover ring separably mounted onto the upper container, so that if necessary, the mirror is replaced with new one or separately discharged from the cover ring very easily.

It is yet another object of the present invention to provide an eco-friendly cosmetic container that is capable of allowing a mirror to be fixed to a cover ring, so that a nameplate is located between the inner peripheral surface of the upper container and the cover ring and thus freely replaced with new one.

To accomplish the above-mentioned objects, according to one aspect of the present invention, there is provided an eco-friendly cosmetic container including: a lower container having a cosmetic material accommodation dish seating portion; an upper container open and closed with respect to the lower container by means of a hinge coupling structure; a cosmetic material accommodation dish seated onto the cosmetic material accommodation dish seating portion; and an intermediate support adapted to be rotatingly locked onto the lower container and released from the locked state over a given region thereof onto and from the lower container to separably fix the cosmetic material accommodation dish to the lower container.

According to the present invention, desirably, the cosmetic material accommodation dish seating portion may include seating ribs adapted to prevent the cosmetic material accommodation dish seated thereonto from moving to left and right sides.

According to the present invention, desirably, the seating ribs protrude upward from the cosmetic material accommodation dish seating portion by a given height, while being spaced apart from each other.

According to the present invention, desirably, the intermediate support rotating with respect to the lower container may have elastic locking pieces coupled or separated to and from locking grooves formed on the lower container so that the intermediate support is locked onto the lower container or released from the locked state.

According to the present invention, desirably, the intermediate support may include: a holder having a cosmetic material ejecting space penetrating a bottom surface thereof to apply a cosmetic material stored in the cosmetic material accommodation dish therethrough; and a cap connected to the holder by means of a hinge on one side thereof and thus openable and closable with respect to the holder.

According to the present invention, desirably, the holder may include: an outer peripheral surface extending outward from top end periphery thereof and thus mounted on the open top end periphery of the lower container when mounted onto the lower container; a cap base extending inward from the bottom end periphery of the outer peripheral surface to thus provide the cosmetic material ejecting space; a support wall extending downward from the outer peripheral surface of the cap base; and the elastic locking pieces protruding from the outer peripheral surface of the support wall and thus locked onto the locking grooves formed on the inner peripheral surface of the lower container and released from the locked states.

According to the present invention, desirably, each locking groove and each elastic locking piece may have a reverse movement prevention projection and a reverse movement prevention groove interlocking with each other to prevent the locked state of the intermediate support onto the lower container from being reversely released.

According to the present invention, desirably, each elastic locking piece of the intermediate support may have an entry portion gradually narrower in width than a rear end portion thereof so that the elastic locking piece is easily inserted into the corresponding locking groove at initial entry.

According to the present invention, desirably, the holder may include support ribs extending downward from the underside of the cap base to thus pressurize the side peripheral surface of the cosmetic material accommodation dish so that when the intermediate support lifts up from the lower container, the cosmetic material accommodation dish lifts up in a state of hanging together with the holder, while coming into close contact with the support ribs of the holder.

According to the present invention, desirably, the holder may have grasping spaces incisedly formed on given portions of the support wall to grasp and thus separate the cosmetic material accommodation dish separated from the lower container in the state of hanging together with the holder.

According to the present invention, desirably, the cap, which is open and closed with respect to the holder, may have a bottom surface on which an inwardly concave accommodation space is formed and a sealing stepped projection protruding from the outer bottom end periphery thereof to allow the cosmetic material ejecting space formed on the bottom surface of the holder to be sealedly blocked from the outside.

According to the present invention, desirably, the holder of the intermediate support may have a locked state display portion formed thereon to notify a user of the locked state of the intermediate support onto the lower container.

According to the present invention, desirably, the intermediate support may include the holder having the cosmetic material ejecting space penetrating the bottom surface thereof to apply the cosmetic material stored in the cosmetic material accommodation dish therethrough, without having any cap.

According to the present invention, desirably, the holder may include rotation controllers formed on top end periphery of the outer peripheral surface thereof to perform the locking and releasing operations.

According to the present invention, desirably, the eco-friendly cosmetic container may further include a mirror disposed inside the upper container and supportedly fixed to a cover ring separately provided, the cover ring being separably mounted onto the upper container.

According to the present invention, desirably, the cover ring may include: a frame open in both directions; a mirror support surface formed one side inner peripheral surface of the frame; one or more elastic support pieces spaced apart from one another at given intervals on the other side of the mirror support surface; and hook members adapted to separably mount the cover ring from the upper container.

According to the present invention, desirably, the cover ring may include a separation piece adapted to perform coupling or separating to or from the upper container.

According to the present invention, desirably, the hook members may include: one or more hook pieces protruding from the inner peripheral surface of the upper container at given intervals; and one or more hook projections spaced apart from one another on the outer peripheral surface of the frame of the cover ring and thus locked onto the hook pieces and released from the locked states, so that the cover ring is directly pressurized against the upper container and separably coupled to the upper container.

According to the present invention, desirably, the hook members may include: one or more hook grooves spaced apart from each other along the inner peripheral surface of the upper container at given intervals; and one or more hook projections spaced apart from each other on the outer peripheral surface of the frame of the cover ring and thus locked onto the hook grooves and released from the locked states, so that the cover ring rotates with respect to the upper container and separably coupled to the upper container.

According to the present invention, desirably, the upper container may be made of a transparent or semi-transparent material and have a nameplate disposed therein so that the nameplate is replaced or separately discharged with new one or from the upper container by means of the separation of the cover ring to which the mirror is supportedly fixed.

According to the present invention, desirably, the open top surface of the cosmetic material accommodation dish seated onto the cosmetic material accommodation dish seating portion of the lower container may be covered with the cap base of the holder having the cosmetic material ejecting space, when the intermediate support is closed, so that the cosmetic material accommodation dish is prevented from escaping upward.

To accomplish the above-mentioned objects, according to another aspect of the present invention, there is provided an eco-friendly cosmetic container including: a lower container having a cosmetic material accommodation dish seating portion; an upper container open and closed with respect to the lower container by means of a hinge coupling structure; a cosmetic material accommodation dish seated onto the cosmetic material accommodation dish seating portion; and an intermediate support adapted to be rotatingly locked onto the lower container and released from the locked state over a given region thereof onto and from the lower container to separably fix the cosmetic material accommodation dish to the lower container, wherein the upper container has a mirror disposed therein, supportedly fixed to a cover ring, and separately discharged therefrom.

To accomplish the above-mentioned objects, according to yet another aspect of the present invention, there is provided an eco-friendly cosmetic container including: a lower container having a cosmetic material accommodation dish seating portion; an upper container open and closed with respect to the lower container by means of a hinge coupling structure; a cosmetic material accommodation dish seated onto the cosmetic material accommodation dish seating portion; and an intermediate support adapted to be rotatingly locked onto the lower container and released from the locked state over a given region thereof onto and from the lower container to separably fix the cosmetic material accommodation dish to the lower container, wherein the upper container has a mirror disposed therein, supportedly fixed to a cover ring, and separately discharged therefrom, the upper container is made of a transparent or semi-transparent material, and between the underside of the cover ring and the inner peripheral surface of the upper container is located a nameplate.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
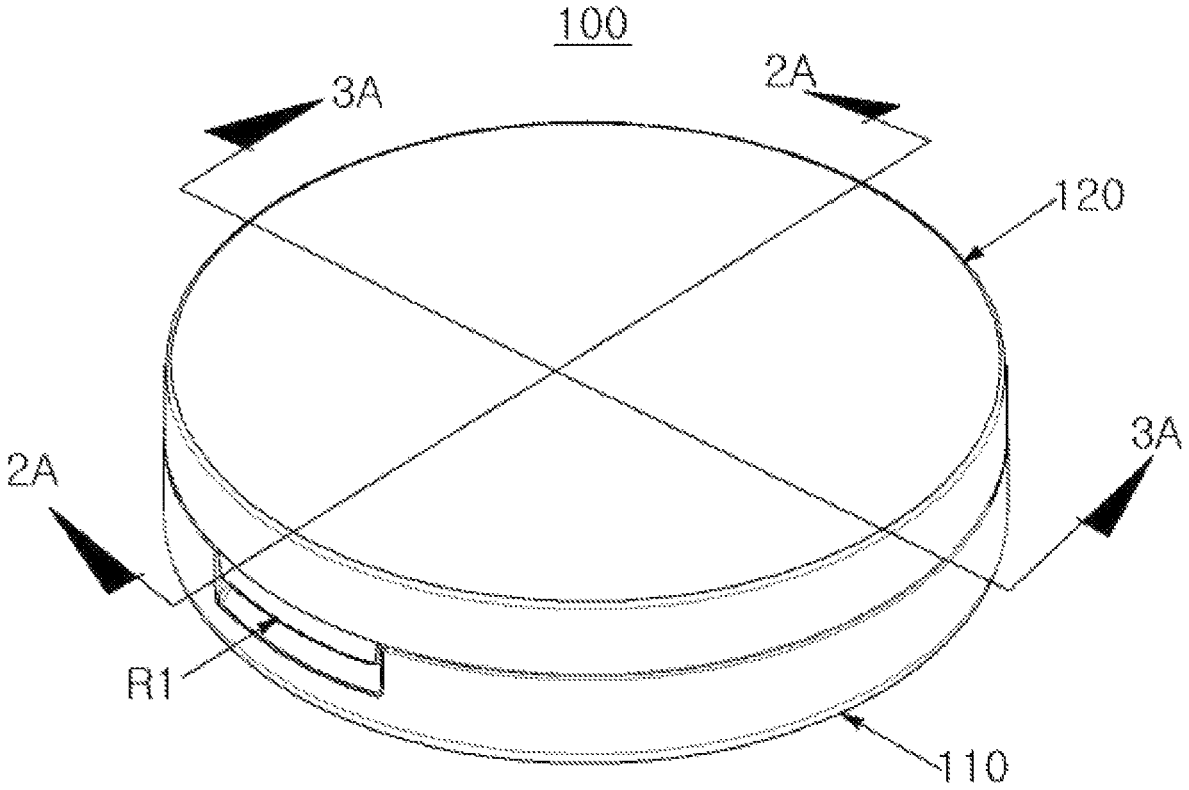
FIG. 1 is a perspective view showing an eco-friendly cosmetic container according to the present invention.
Figure 2:
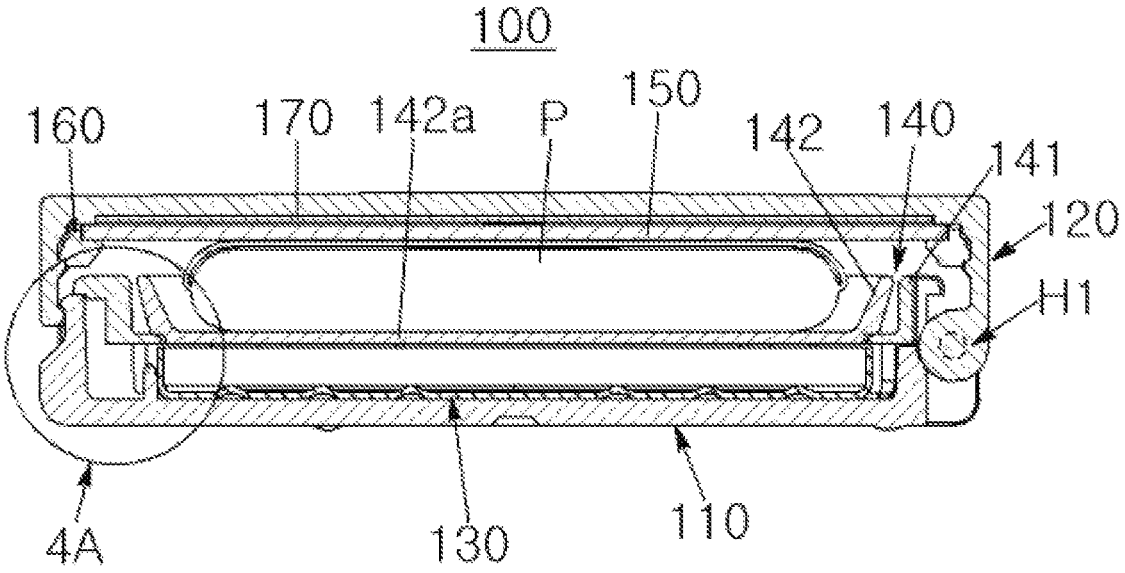
FIG. 2 is a sectional view taken along the line 2A-2A of FIG. 1.
Figure 3:
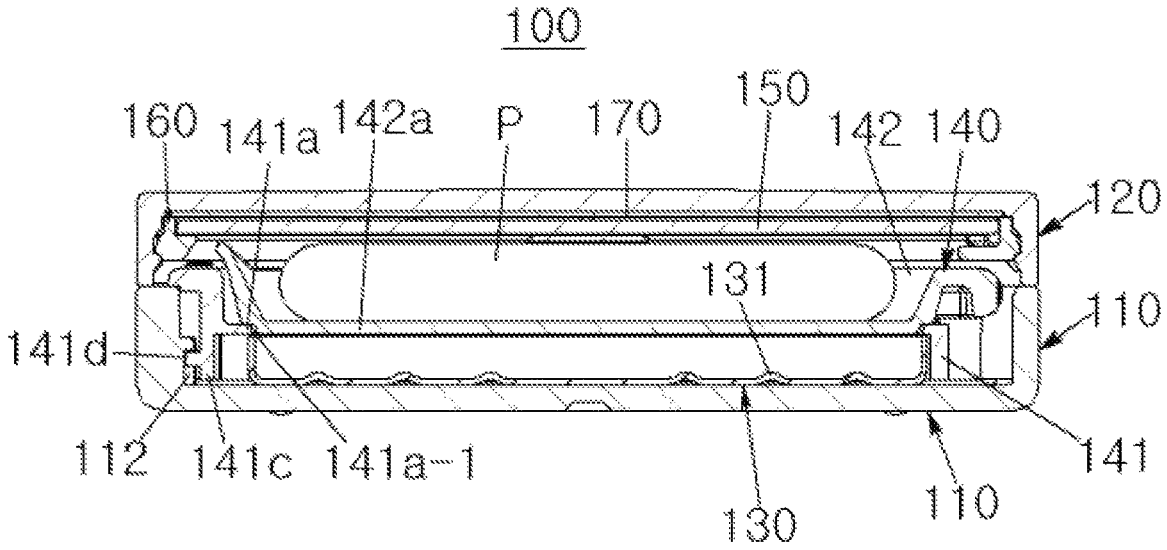
FIG. 3 is a sectional view taken along the line 3A-3A of FIG. 1.

Hereinafter, embodiments of the present invention will be explained in detail with reference to the attached drawings.

Referring to FIGS. 1 to 21, an eco-friendly cosmetic container 100 according to the present invention includes: a lower container 110, an upper container 120, a cosmetic material accommodation dish 130, an intermediate support 140, a mirror 150, a cover ring 160 for covering the mirror 150, and a nameplate 170.

The lower container 110 and the upper container 120 are configured to be open in opposite directions to each other and connected to each other by means of a hinge H1 disposed on their one side to be thus open and closed.

The hinge H1 is configured to allow hinge protrusions formed as both side walls of an open incised groove of the lower container 110 to be insertedly coupled to hinge grooves facingly formed on a hinge block of the upper container 120.

The upper container 120 connected to the lower container 110 by means of the hinge H1 serves as a cap for the cosmetic container 100.

Moreover, the lower container 110 and the upper container 120 are locked onto each other and released from the locked states by means of a locker R1.

The lower container 110 and the upper container 120 may be made of various materials such as a synthetic resin and may be transparent, opaque, or semi-transparent.

In specific, the upper container 120 is either transparent or semi-transparent if the nameplate 170 is applied and is then coupled to the lower container 110, so that the nameplate 170 can be seen through the upper container 120.

The lower container 110 has a cosmetic material accommodation dish seating portion 111 formed on the bottom thereof.

The cosmetic material accommodation dish seating portion 111 has seating ribs 111*a* adapted to prevent the cosmetic material accommodation dish 130 seated thereonto from moving to left and right sides.

The seating ribs 111*a* protrude upward from the cosmetic material accommodation dish seating portion 111 by a given height, while being spaced apart from each other.

Desirably, one or more seating ribs 111*a* protrude from the cosmetic material accommodation dish seating portion 111, while being spaced apart from each other, so that it is easy to seat or separate the cosmetic material accommodation dish 130 onto or from the cosmetic material accommodation dish seating portion 111.

The cosmetic material accommodation dish 130 seated onto the cosmetic material accommodation dish seating portion 111 is stably supported by the seating ribs 111*a* supporting the side peripheral surface thereof.

The lower container 110 has one or more locking grooves 112 spaced apart from one another along the inner peripheral surface thereof and having one side open in the same direction to one another and the other hand blocked.

The cosmetic material accommodation dish 130 serves to store a cosmetic material for various makeup purposes therein and is open in one direction to provide a space in which the cosmetic material is stored.

The cosmetic material accommodation dish 130 has various concavo-convex portions 131 formed on the bottom thereof to stably fill the cosmetic material therein and to prevent the cosmetic material from moving while it is being used.

Further, the cosmetic material accommodation dish 130 is made of a material such as a synthetic resin and a metal.

If the cosmetic material accommodation dish 130 is made of a metal, it has a relatively low thickness, and desirably, the cosmetic material accommodation dish 130 is made of one or more materials selected from stainless steel, Iron (Fe), aluminum (Al), copper (Cu), tungsten (W), nickel (Ni), tin (Sn), magnesium (Mg), calcium (Ca), titanium (Ti), zinc (Zn), and gallium (Ga).

The cosmetic material accommodation dish 130 is replaceable with a refill dish after the cosmetic container stored therein has been used up.

The cosmetic material accommodation dish 130 is can be stably seated and separated onto and from the cosmetic material accommodation dish seating portion 111 by means of rotary opening and closing of the intermediate support 140.

The intermediate support 140 includes a holder 141 having a cap base 141*a* and a cosmetic material ejecting space 141*a*-1 penetrating the cap base 141*a* to apply the cosmetic material stored in the cosmetic material accommodation dish 130 therethrough and a cap 142 connected to the holder 141 by means of a hinge H2 on one side thereof and thus openable and closable with respect to the holder 141.

In the same way as the hinge H1 connecting the lower container 110 and the upper container 120, the hinge H2 is configured to allow hinge protrusions formed as both side walls of an open incised groove of the holder 141 to be insertedly coupled to hinge grooves facingly formed on a hinge block of the cap 142.

When mounted onto the lower container 110, the holder 141 of the intermediate support 140 allows an outer peripheral surface 141*b* extending outward from top end periphery thereof to be mounted on the open top end periphery of the lower container 110.

Further, the holder 141 includes the cap base 141*a* extending inward from the bottom end periphery of the outer peripheral surface 141*b* of the holder 141, a support wall 141*c* extending downward from the outer peripheral surface of the cap base 141*a*, and elastic locking pieces 141*d* protruding from the outer peripheral surface of the support wall 141*c* and thus locked onto locking grooves 112 formed on the inner peripheral surface of the lower container 110 and released from the locked states.

In this case, given portions of the support wall 141*c* corresponding to the elastic locking pieces 141*d* protruding therefrom are partially incised on both sides thereof so that the elastic locking pieces 141*d* are elastically locked onto the locking grooves 112.

Figure 8:
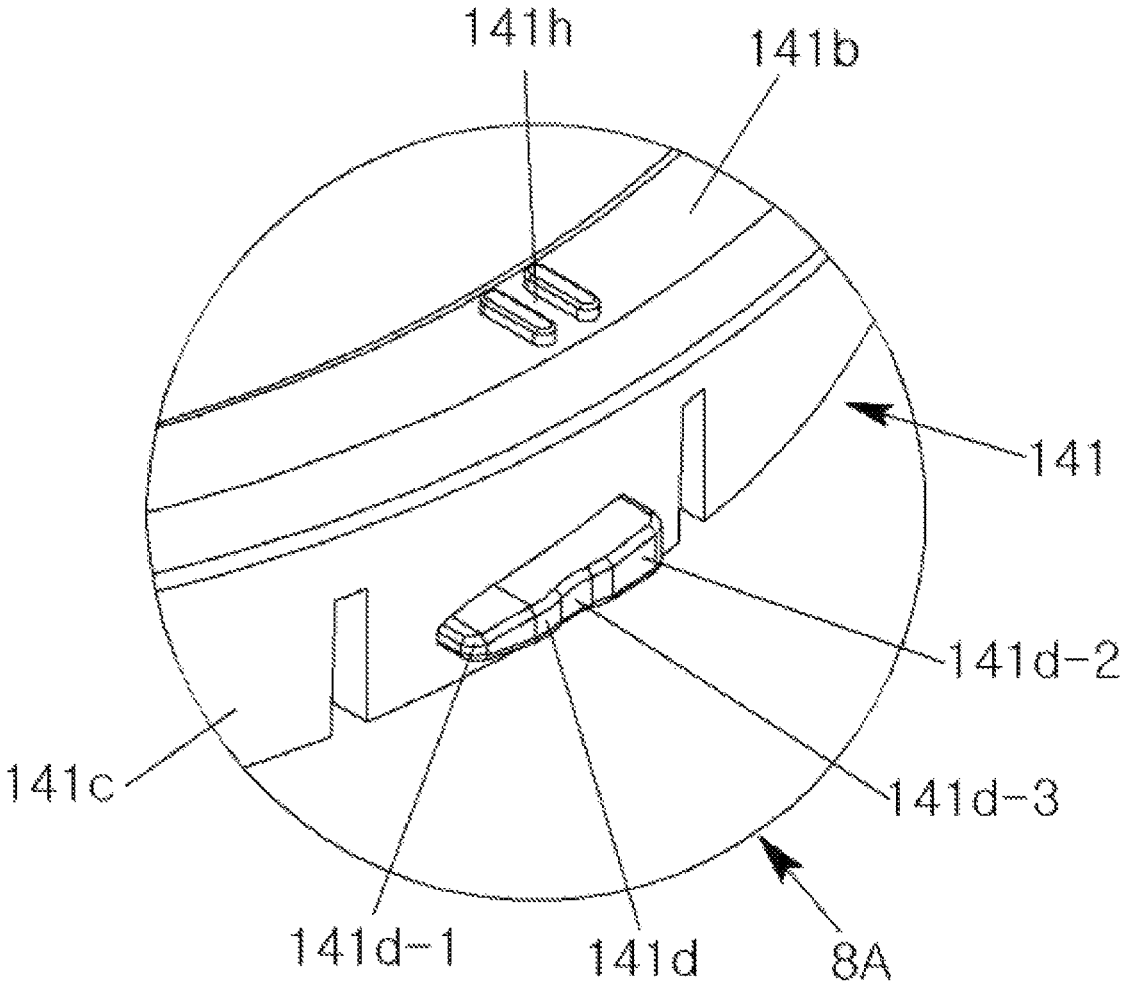
FIG. 8 is an enlarged view showing a portion 8A of FIG. 7.

Moreover, as shown in FIG. 8, each elastic locking piece 141*d* has an entry portion 141*d*-1 gradually narrower in width than a rear end portion 141*d*-2 so that the elastic locking piece 141*d* can be easily inserted into the corresponding locking groove 112 at initial entry.

Figure 9:
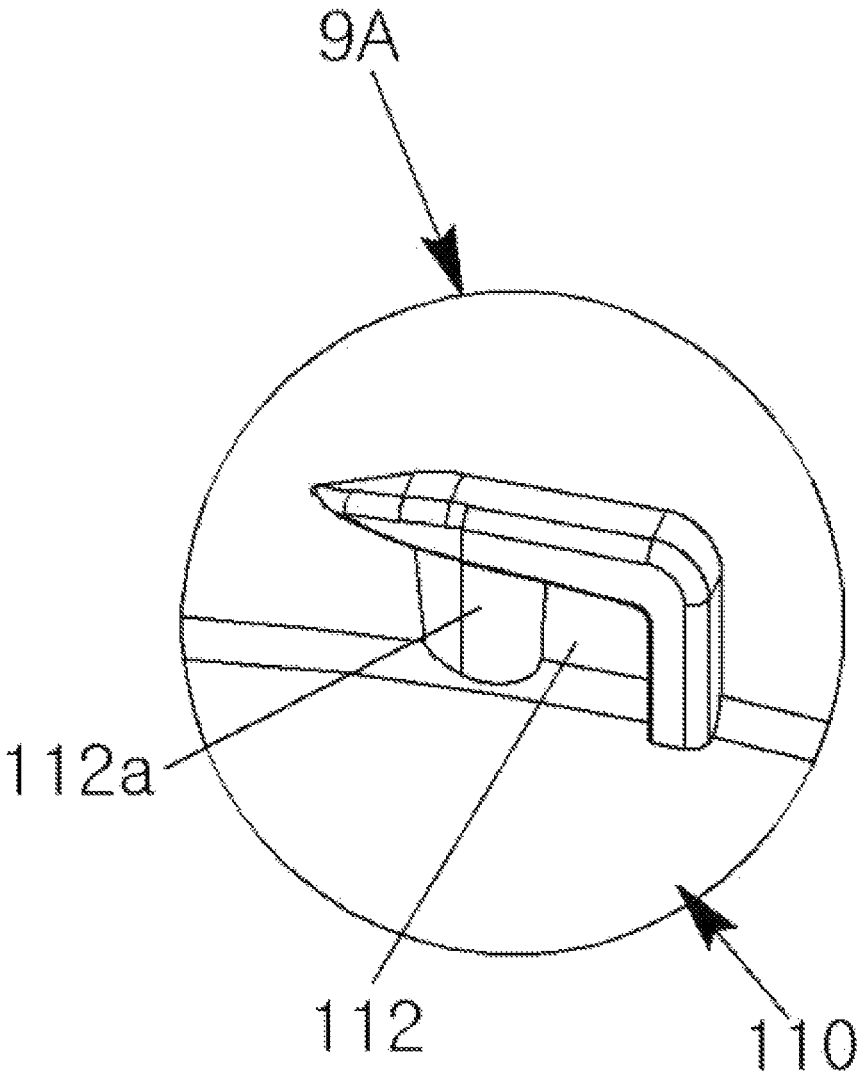
FIG. 9 is an enlarged view showing a portion 9A of FIG. 7.

Further, as shown in FIGS. 8 and 9, each locking groove 112 and each elastic locking piece 141*d* have a reverse movement prevention projection 112*a* and a reverse movement prevention groove 141*d*-3 for preventing the locked state of the intermediate support 140 onto the lower container 110 from being reversely released, owing to the reverse rotation of the intermediate support 140, after the intermediate support 140 has rotated in a locking direction onto the lower container 110 to stably support the cosmetic material accommodation dish 130.

As the intermediate support 140 rotates in the locking direction (in a clockwise direction for the conveniences of the description), therefore, the elastic locking pieces 141*d* formed on the support wall 141*c* of the holder 141 move and are thus locked onto the locking grooves 112 formed on the lower container 110, so that the cosmetic material accommodation dish 130, which is seated onto the cosmetic material accommodation dish seating portion 111 of the lower container 110, is stably locked onto the lower container 110. In this case, the intermediate support 140 is prevented from the arbitrary reverse rotation with respect to the lower container 110 by means of the interlocking between the reverse movement prevention projections 112*a* formed on the locking grooves 112 and the reverse movement prevention locking pieces 141*d*-3 formed on the elastic locking pieces 141*d*, thereby enabling the locked state to be more stably maintained.

As the intermediate support 140 rotates in a releasing direction (in a counterclockwise direction for the conveniences of the description), contrarily, the elastic locking pieces 141*d* formed on the support wall 141*c* of the holder 141 are ejected from the locking grooves 112 formed on the lower container 110, so that the locked state is forcedly released to allow the cosmetic material accommodation dish 130 to become separately discharged from the cosmetic material accommodation dish seating portion 111.

When the intermediate support 140 rotates in the locking direction, meanwhile, the cosmetic material accommodation dish 130 seated onto the cosmetic material accommodation dish seating portion 111 of the lower container 110 is configured to allow the open top peripheral surface thereto to be covered with the cap base 141*a* of the holder 141 having the cosmetic container ejecting space 141*a*-1, thereby being prevented from escaping upward.

According to the present invention, when the intermediate support 140 is released from the locking state onto the lower container 110, the cosmetic material accommodation dish 130 can be freely separately discharged from the cosmetic material accommodation dish seating portion 111 of the lower container 110, without any interference with the holder 141.

On the other hand, as shown in FIGS. 11 to 15, when the intermediate support 140 is released from the locking state onto the lower container 110, given portions of the outer peripheral surface of the holder 141 forcedly come into close contact with the open top end periphery of the lower container 110 by means of support ribs 141*e* extending downward from the underside of the cap base 141*a*, so that upon separation of the intermediate support 140 from the lower container 110, the cosmetic material accommodation dish 130 lifts up in a state of hanging together with the holder 141 and is thus separable from the lower container 110.

In this case, the support wall 141*c* of the holder 141 of the intermediate support 140 has grasping spaces 141*f* formed on given portions thereof so that the cosmetic material accommodation dish 130, which is separated from the lower container 110 in the state of hanging together with the holder 141, can be grasped on the exposed portions by the grasping spaces 141*f* and thus separated from the holder 141.

Even if the grasping spaces 141*f* are not formed on the support wall 141*c*, it is possible that after the cap 142 is open with respect to the holder 141, the cosmetic material accommodation dish 130 is ejected and thus separated by means of the cosmetic material ejecting space 141*a*-1, but as the grasping spaces 141*f* are formed on the given portions of the support wall 141*c* of the holder 141, the cosmetic material accommodation dish 130 can be quickly separated even in a state where the cap 142 is not open intentionally.

Further, the cap 142, which is open and closed with respect to the holder 141 by means of the hinge H2, has a bottom surface 142*a* on which an inwardly concave accommodation space 142*b* is formed.

The accommodation space 142*b* serves to store all types of makeup tools such as a makeup puff.

Moreover, the cap 142 has a handle 142*c* adapted to perform opening and closing operations with respect to the holder 141.

Figure 4:
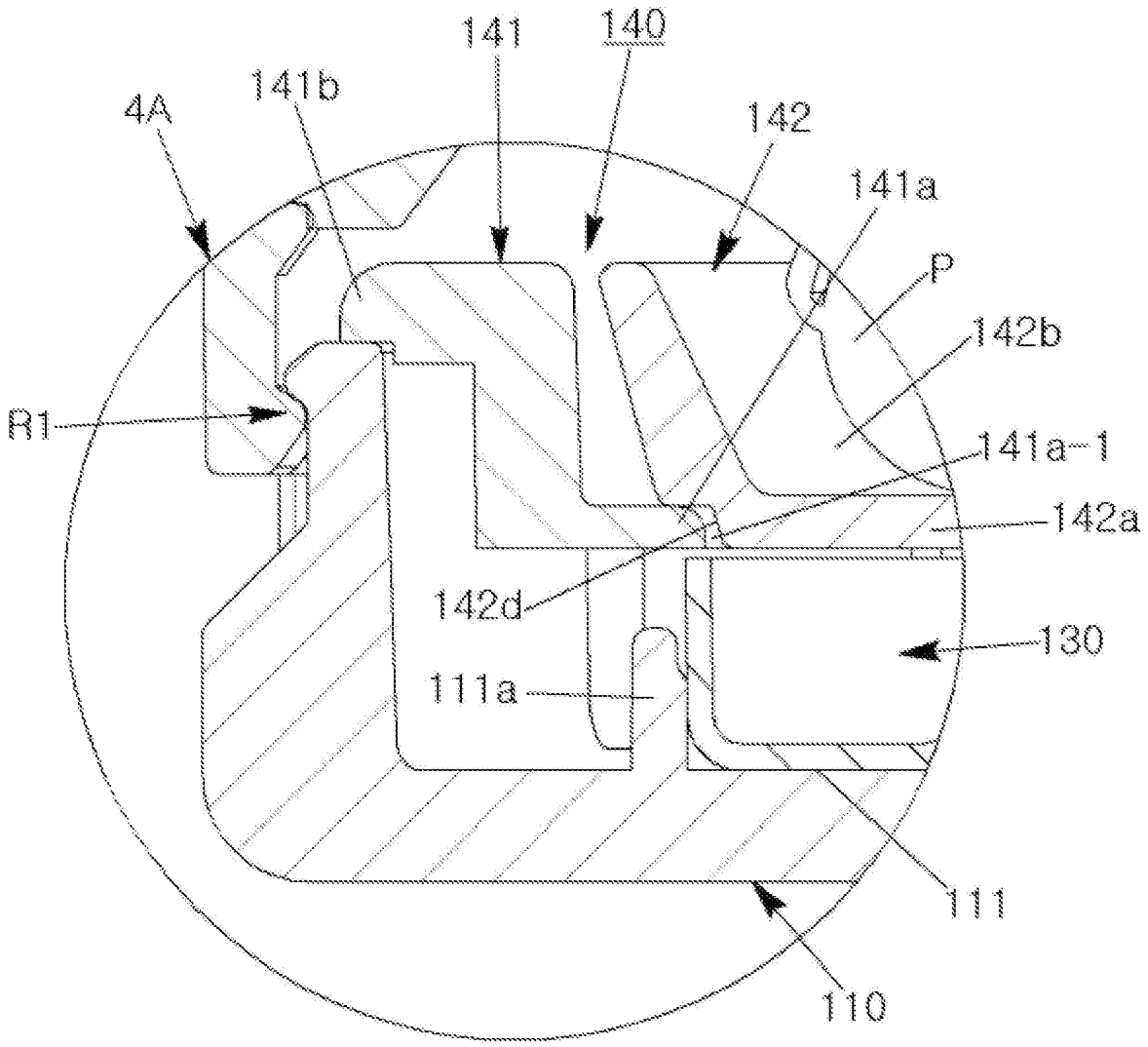
FIG. 4 is an enlarged sectional view showing a portion 4A of FIG. 2.
Figure 5:
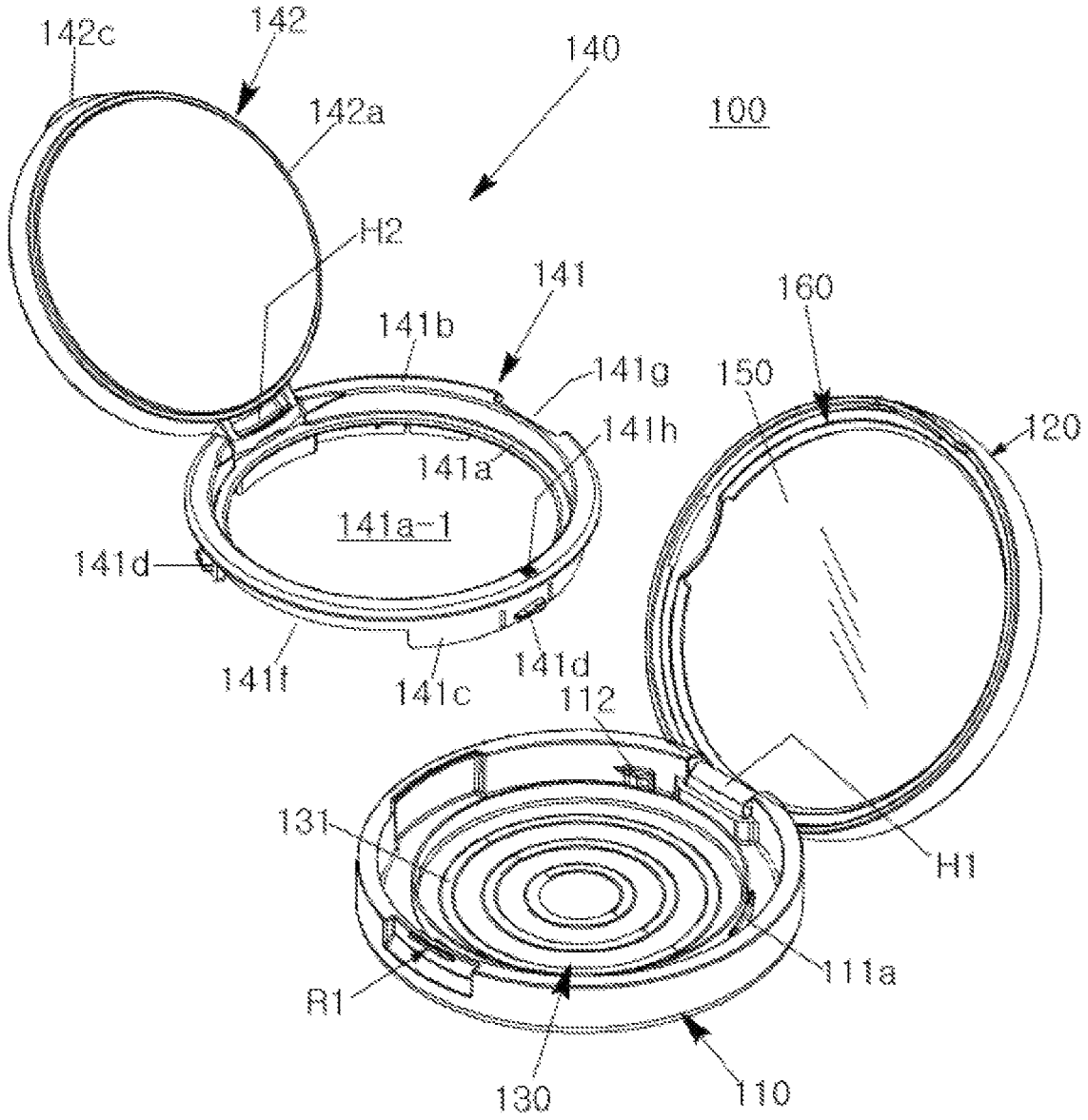
FIG. 5 is an exploded perspective view showing a state where only a cosmetic material accommodation dish is seated onto a lower container in the eco-friendly cosmetic container according to the present invention.
Figure 6:
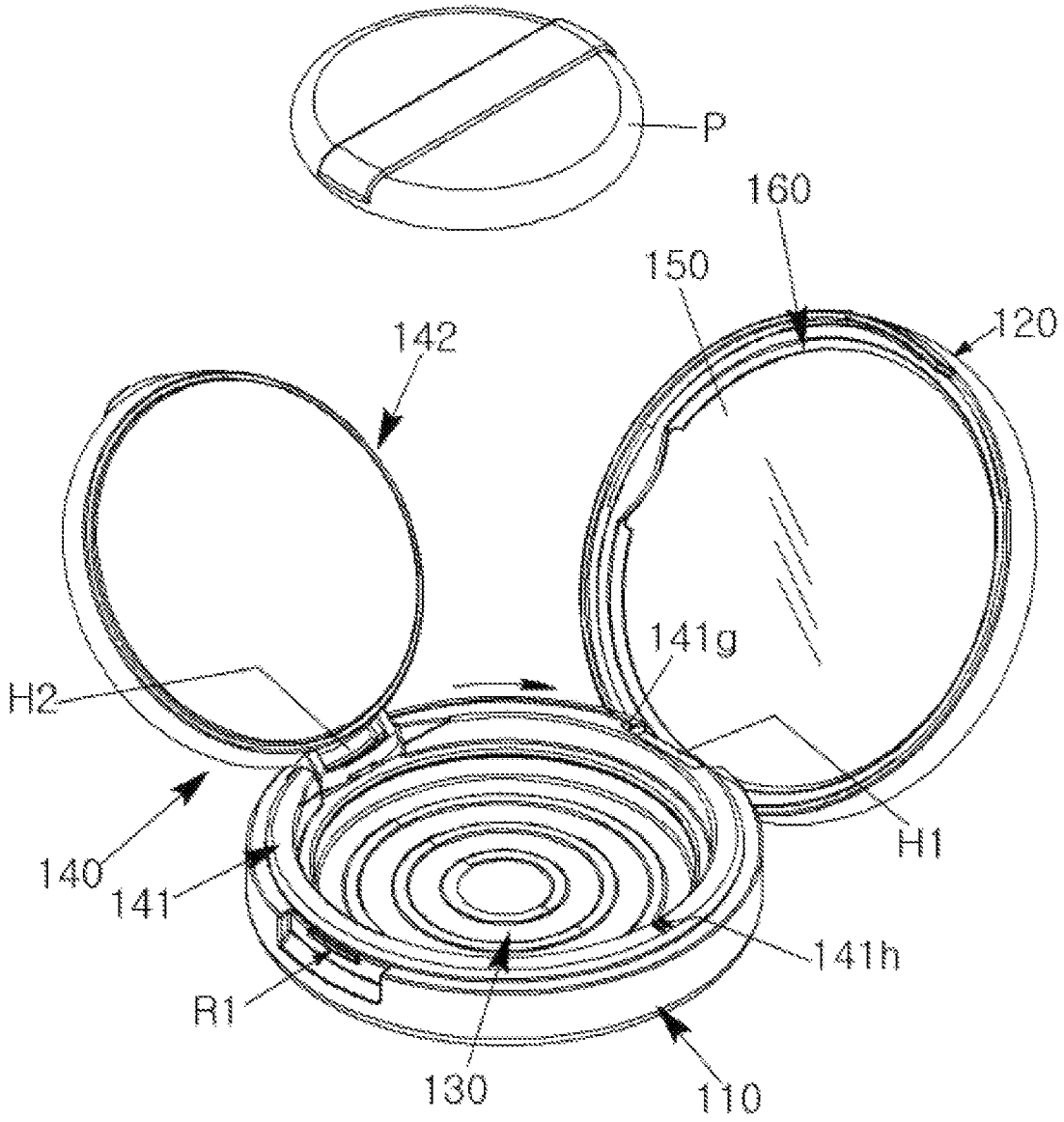
FIG. 6 is a perspective view showing a state where an upper container and a cap are open and a puff is separated, while the cosmetic material accommodation dish is being seated onto the lower container by means of a holder of an intermediate support, in the eco-friendly cosmetic container according to the present invention.
Figure 7:
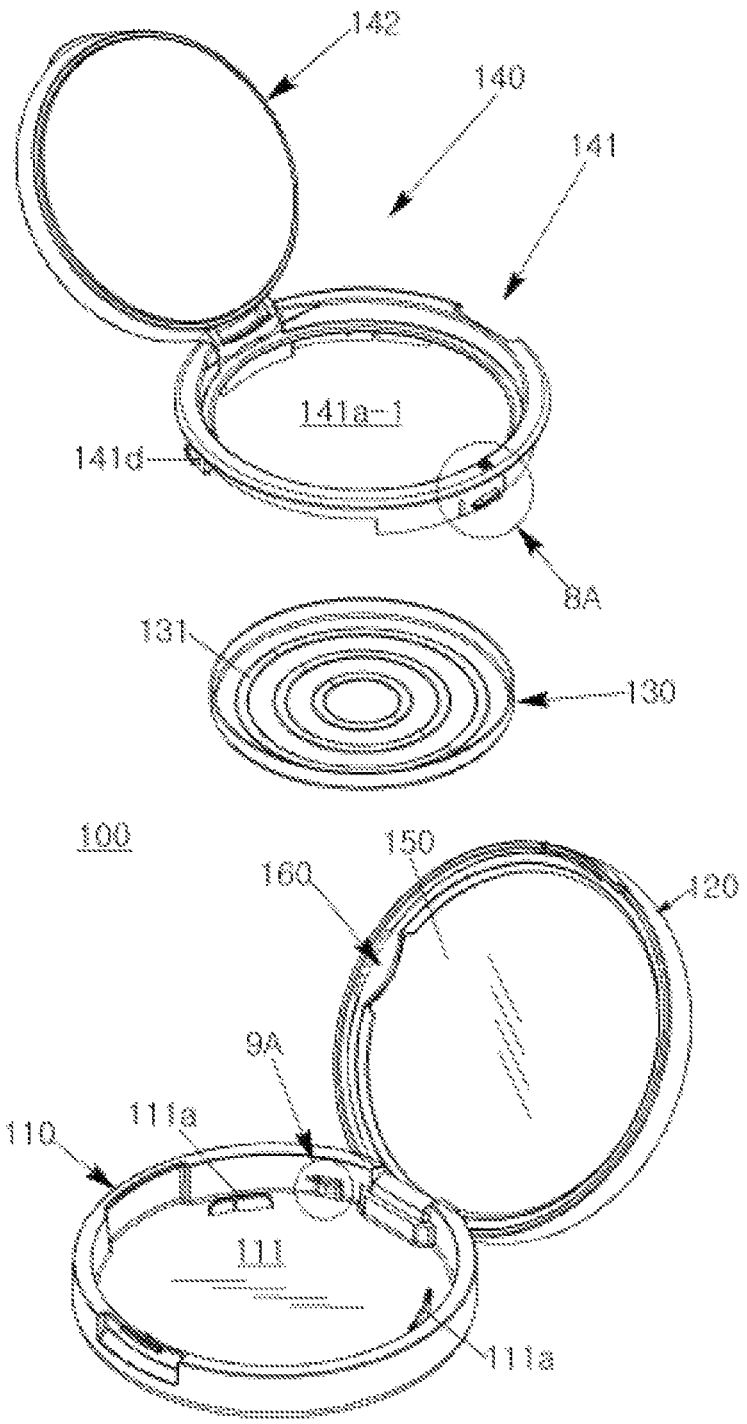
FIG. 7 is an exploded perspective view showing the eco-friendly cosmetic container according to the present invention.

Further, as shown in FIG. 4, the cap 142 has a sealing stepped projection 142*d* protruding from the outer bottom end periphery thereof to allow the cosmetic material ejecting space 141*a*-1 formed on the bottom surface 141*a* of the holder 141 to be sealedly blocked from the outside.

When the cap 142 is closed, in specific, the cosmetic material ejecting space 141*a*-1 penetratingly formed on the bottom surface 141*a* of the holder 141 is sealedly blocked from the outside by means of the sealing stepped projection 142*d*, so that while the cosmetic container is carried or kept in place, the cosmetic material placed in the cosmetic material accommodation dish 130 is effectively prevented from leaking or scattering to the outside.

Further, the holder 141 of the intermediate support 140 has a locked state display portion 141*g* formed thereon to notify a user of the locked state of the intermediate support 140 onto the lower container 110.

The locked state display portion 141*g* is incisedly formed on the outer peripheral surface 141*b* of the holder 141 to correspond to the hinge H1 when the intermediate support 140 is locked onto the lower container 110, and of course, the locked state display portion 141*g* may be freely formed in various methods.

Figure 10:
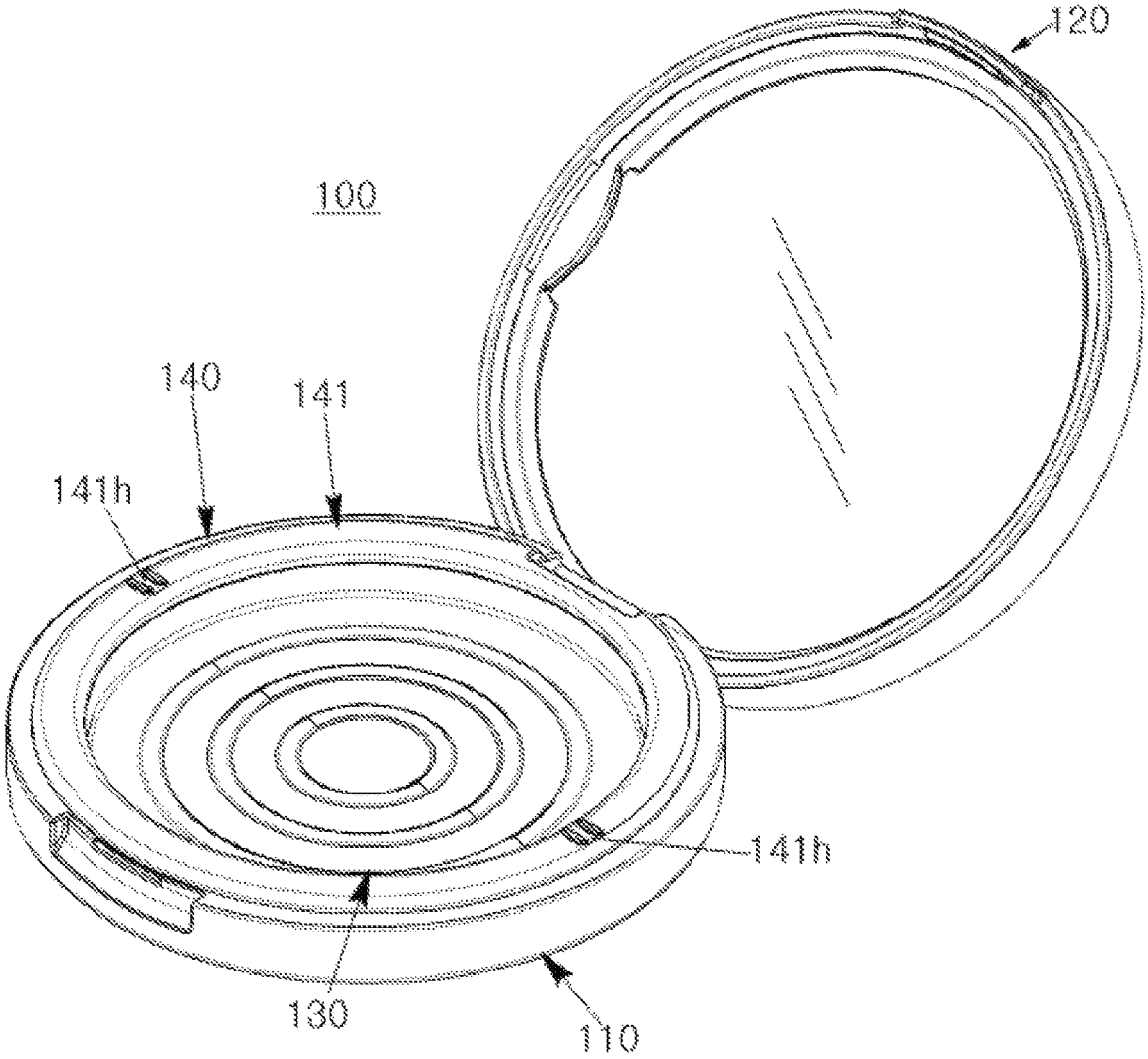
FIG. 10 is a partially open perspective view showing another example of the intermediate support in the eco-friendly cosmetic container according to the present invention.
Figure 11:
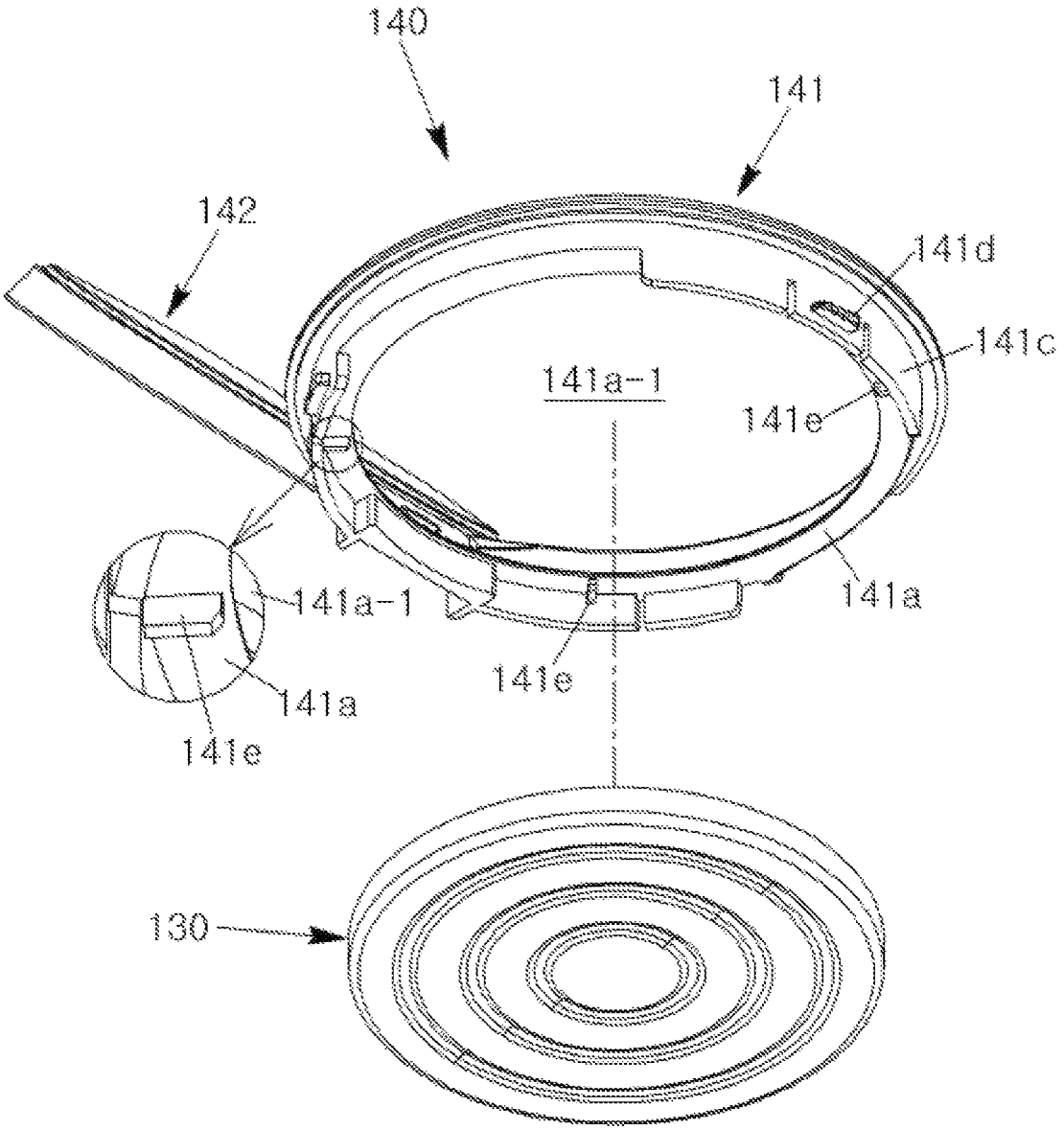
FIG. 11 is a perspective view showing a state where the intermediate support has support ribs for supporting the cosmetic material accommodation dish in the eco-friendly cosmetic container according to the present invention.
Figure 12:
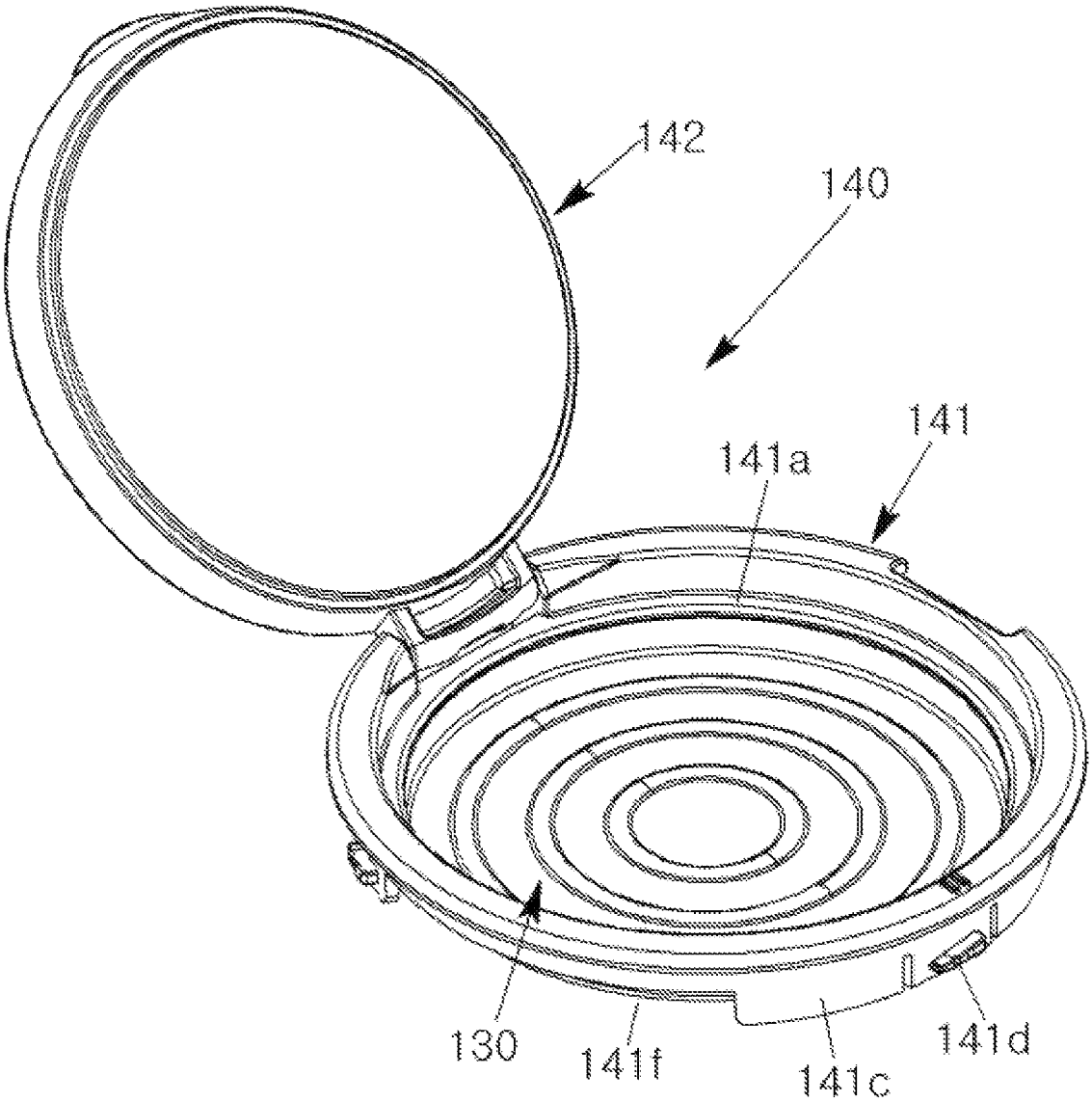
FIG. 12 is a perspective view showing a state where the cosmetic material accommodation dish moves up after have been mounted in the holder by means of the support ribs of the intermediate support in FIG. 11.
Figure 13:
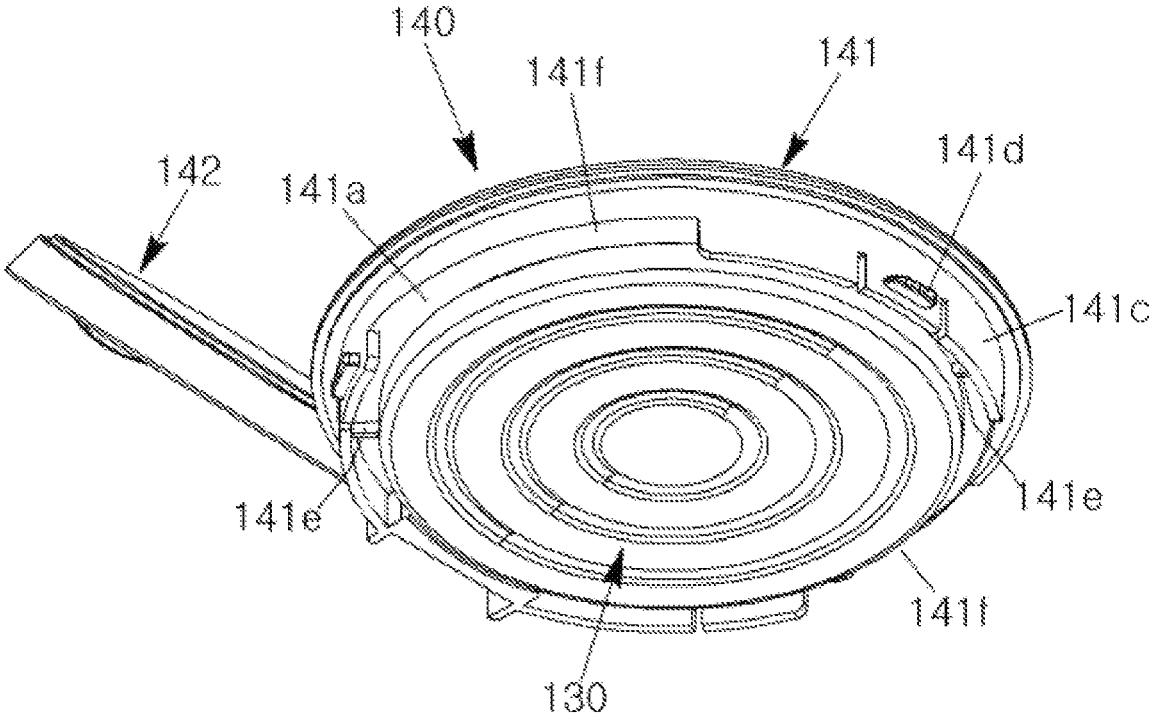
FIG. 13 is a bottom perspective view of FIG. 12.
Figure 14:
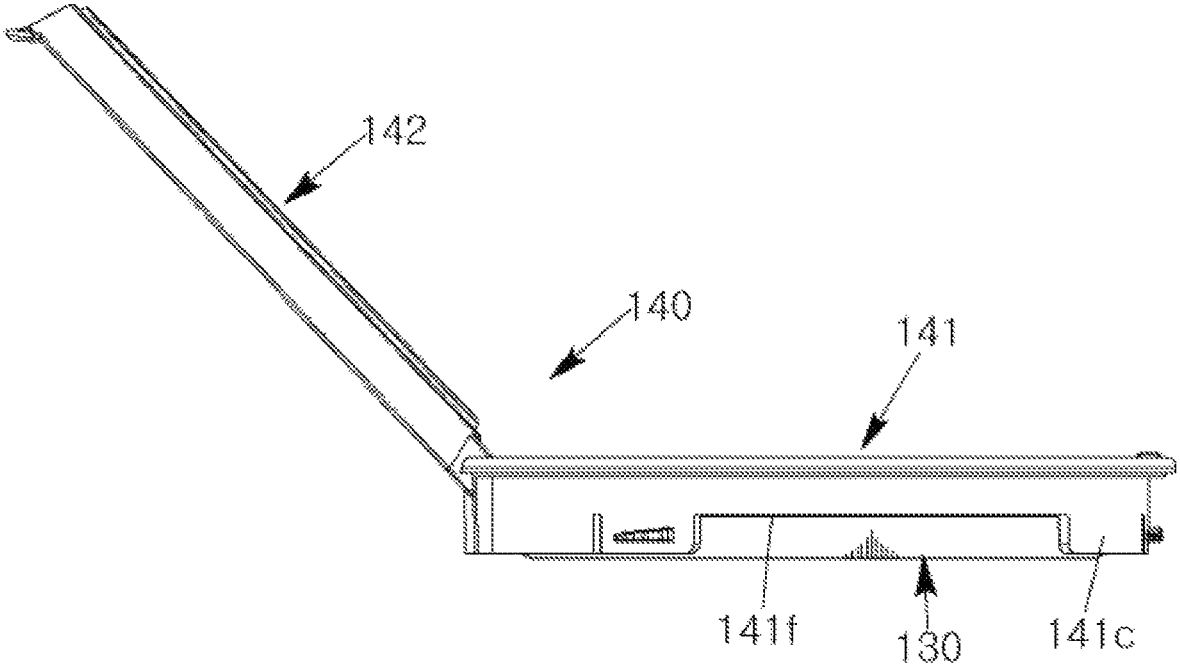
FIG. 14 is a side view of FIG. 13.
Figure 15:
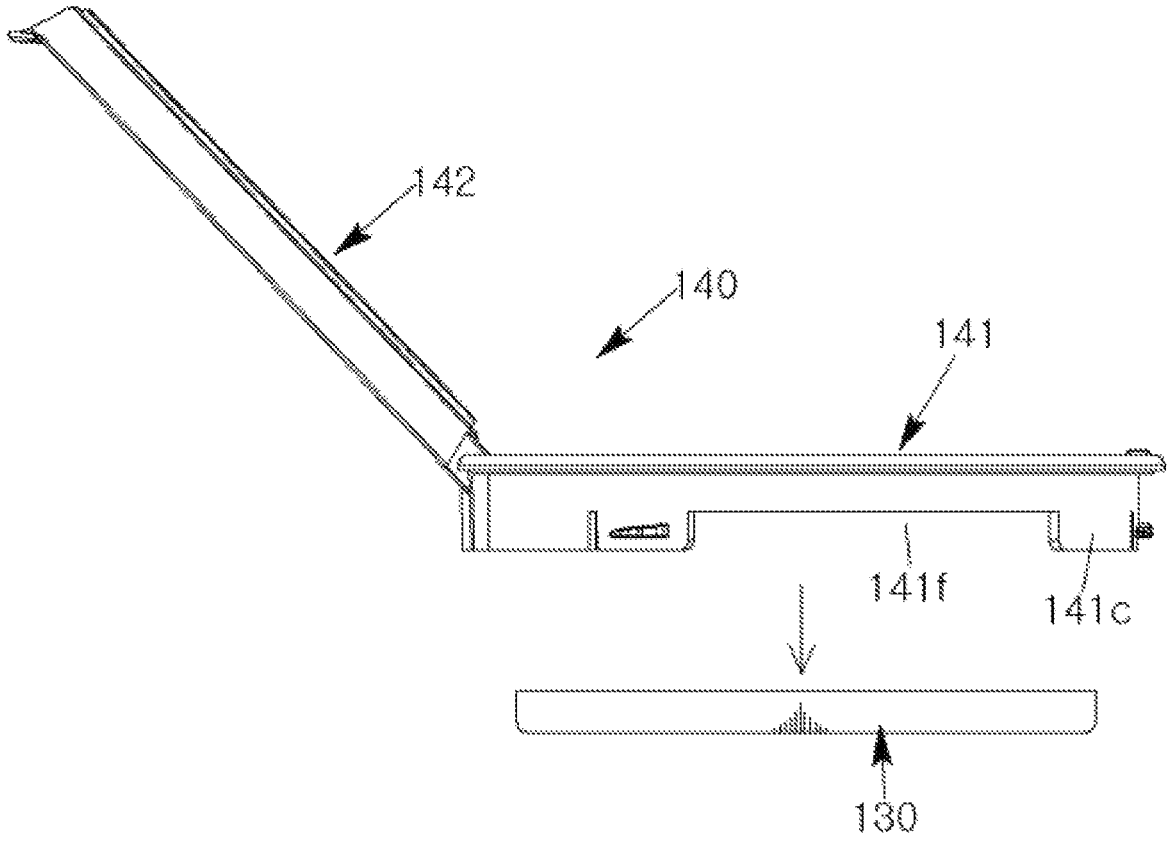
FIG. 15 is a side view showing a state where the cosmetic material accommodation dish is separated from the lower container through grasping spaces formed in the holder of the intermediate support in FIG. 14.

According to the present invention, as shown in FIG. 10, the intermediate support 140 has only the holder 141, without any cap 142.

In this case, the holder 141 is configured in the same manner as in the intermediate support 140 having the cap 142, excepting the hinge H2 connected thereto, and therefore, an explanation of the holder 141 will be avoided for the brevity of the description.

As the intermediate support 140 has only the holder 141, the simplification in the number of parts can be achieved.

In this case, however, the holder 141 further includes rotation controllers 141*h* formed on top end periphery of the outer peripheral surface 141*b* thereof.

The rotation controllers 141*h* may be formed on the top end periphery of the holder 141 of the intermediate support 140 configured to have both of the holder 141 and the cap 142.

In this case, the rotation controllers 141*h* have the shapes of protrusions as shown, and otherwise, they may have free shapes such as concavo-convex portions only if their function can be achieved.

When the holder 141 rotates, the rotation controllers 141*h* generate friction with the user's hand palm to prevent the holder 141 from slipping from his or her hand palm, and otherwise, the holder 141 may simply rotate using other tools.

The rotation of the holder 141 is performed more easily by means of the rotation controllers 141*h*, and through the rotation of the holder 141, further, it is possible that the cosmetic material accommodation dish 130 is locked onto the lower container 110 and released from the locked state onto the lower container 110.

According to the present invention, the mirror 150 is disposed in the interior of the upper container 120 and thus used for makeup.

The mirror 150 is made of glass or other glass-replaceable materials and formed as a concave or convex mirror.

The mirror 150 is separably fixed to the upper container 120 by means of a cover ring 160 detachable from the inner peripheral surface of the upper container 120.

The cover ring 160 includes a frame 161 open in both directions thereof, a mirror support surface 162 formed one side inner peripheral surface of the frame 161 to seat one side peripheral surface of the mirror 150 thereonto when the mirror 150 is fittedly pushed in one direction, one or more elastic support pieces 163 spaced apart from one another at given intervals on the other side of the mirror support surface 162, and hook members 164 adapted to perform the detachable operation from the upper container 120 and having parts as will be discussed below formed on the upper container 120.

Further, the cover ring 160 includes a separation piece 165 adapted to separate the mirror 150 from the frame 161. The separation piece 165 may have various shapes such as a handle according to the separation and coupling structures of the hook members 164.

The mirror 150 is manufactured independently and thus coupled to the cover ring 160, and accordingly, the mirror 150 does not have any conventional structure in which it is attached to the upper container 120 by means of a double-side tape or adhesive.

Further, the mirror 150 is elastically supported stably between the mirror support surface 162 and the elastic support pieces 163 of the cover ring 160, so that unless a strong external force is applied, the mirror 150 is not arbitrarily separated from the cover ring 160. If it is desired to replace or separate the mirror 150, the cover ring 160 is first separated from the upper container 120, and next, the mirror 150 pushes toward the elastic support pieces 163, so that the locked state of the mirror 150 onto the elastic support pieces 163 is released to cause the mirror 150 to be separated from the cover ring 160, thereby enabling the mirror 150 to be separately discharged from the cover ring 160 more easily and quickly.

However, the hook members 164, which are adapted to detachably mount the cover ring 160 onto the upper container 120, are not limited to the specific embodiment of the present invention, and the detachable mounting may be freely performed by means of pressurizing, rotating, and the like.

Figure 16:
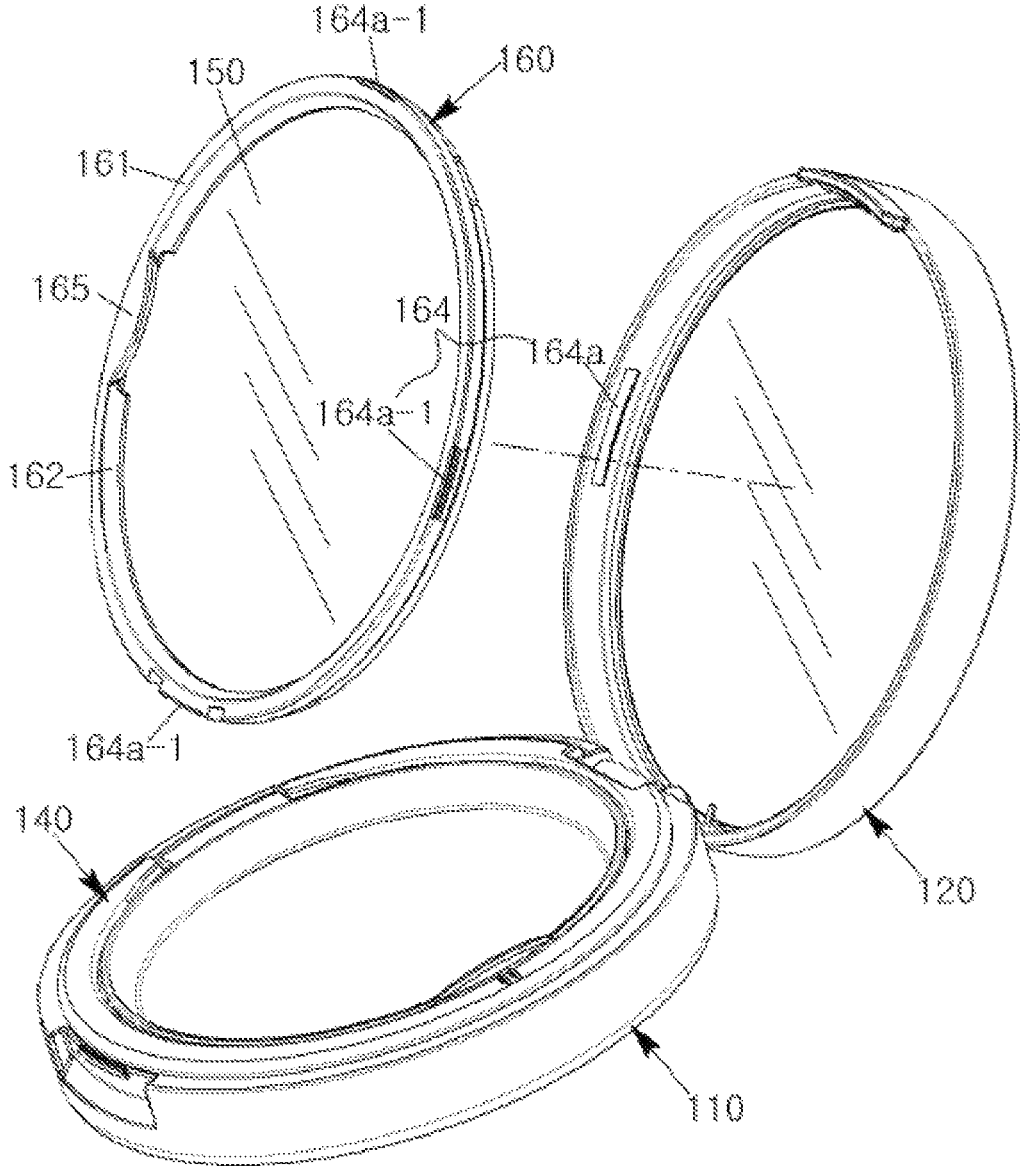
FIG. 16 is a partial perspective view showing a state where a cover ring is coupled to a mirror and separated from the upper container by means of pressurizing hook members in the eco-friendly cosmetic container according to the present invention.
Figure 17:
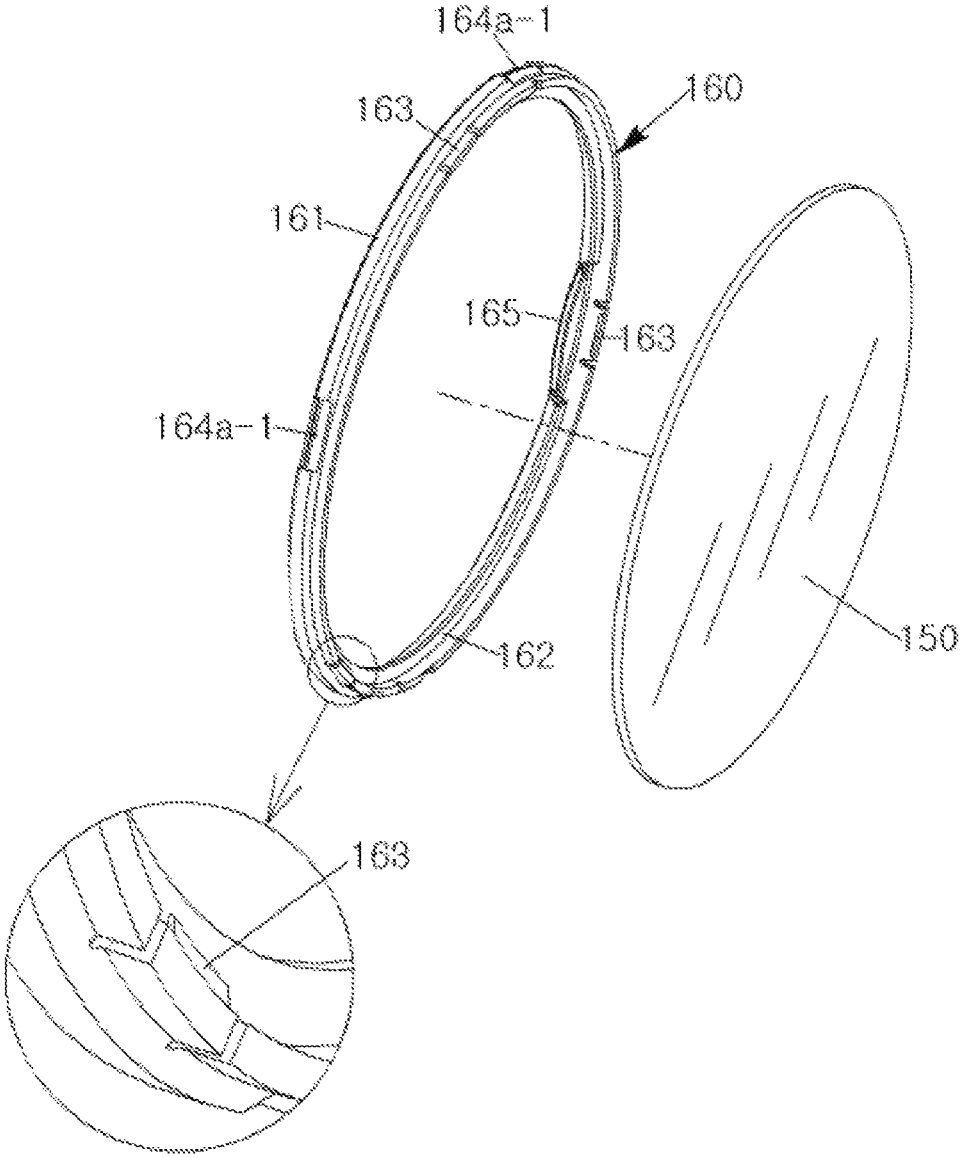
FIG. 17 is an exploded perspective view showing a state where the mirror is separated from the cover ring in FIG. 16.
Figure 18:
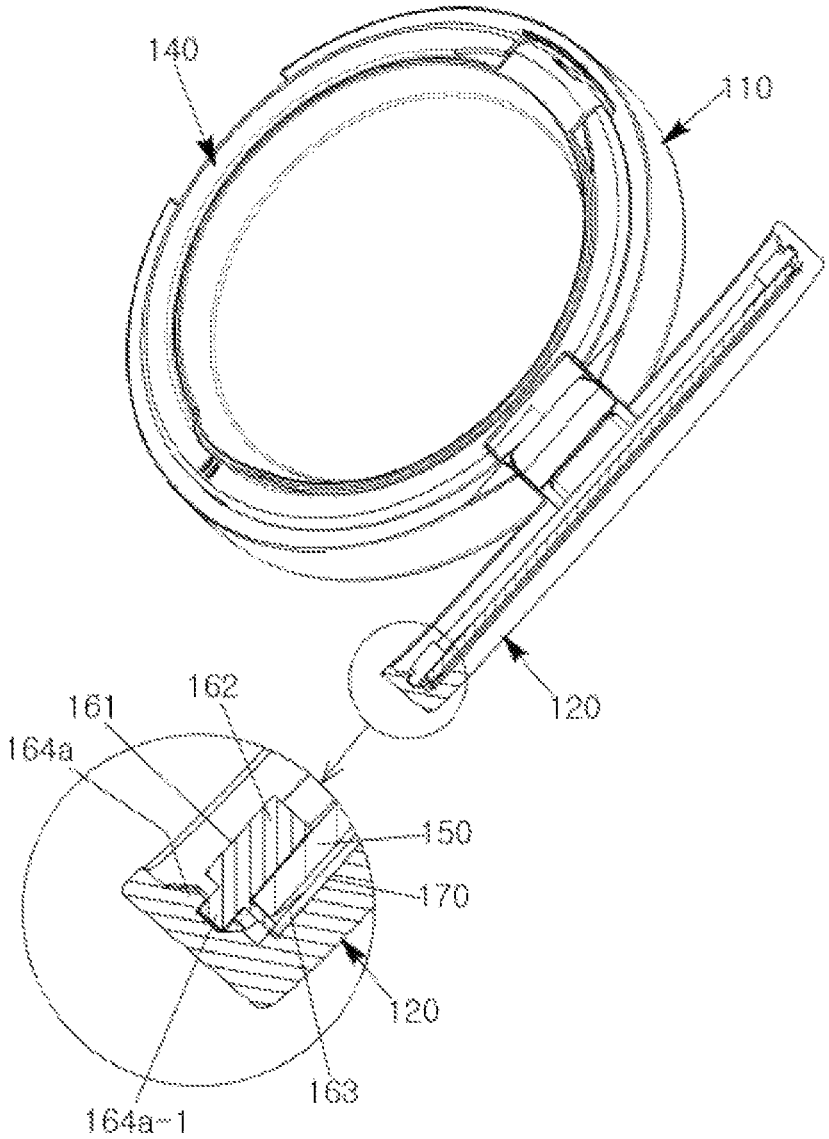
FIG. 18 is a sectional view showing a state where the cover ring coupled to the mirror is coupled to the upper container by means of the pressuring hook members in FIG. 16.

For example, as shown in FIGS. 16 to 18, the hook members 164 include one or more hook pieces 164*a* protruding from the inner peripheral surface of the upper container 120 at given intervals and hook projections 164*a*-1 spaced apart from one another on the outer peripheral surface of the frame 161 of the cover ring 160 and thus locked onto the hook pieces 164*a* and released from the locked states, so that the cover ring 160 is directly pressurized against the upper container 120 and thus separably coupled to the upper container 120.

In the case where the pressurizing method using the hook pieces 164*a* and the hook projections 164*a*-1 of the hook members 164 is applied, the cover ring 160 is first located inside the upper container 120, then pressurized against the upper container 120, and finally lockedly coupled to the upper container 120. If it is desired to separate the cover ring 160 from the upper container 120, the cover ring 160 is ejected from the upper container 120 by means of the separation piece 165 in the opposite direction to the pressurizing direction, and otherwise, if the upper container 120 hits on an object to which shocks are applied, such as a desk, a table, and the like, so that the cover ring 160 may be easily ejected from the upper container 120.

Figure 19:
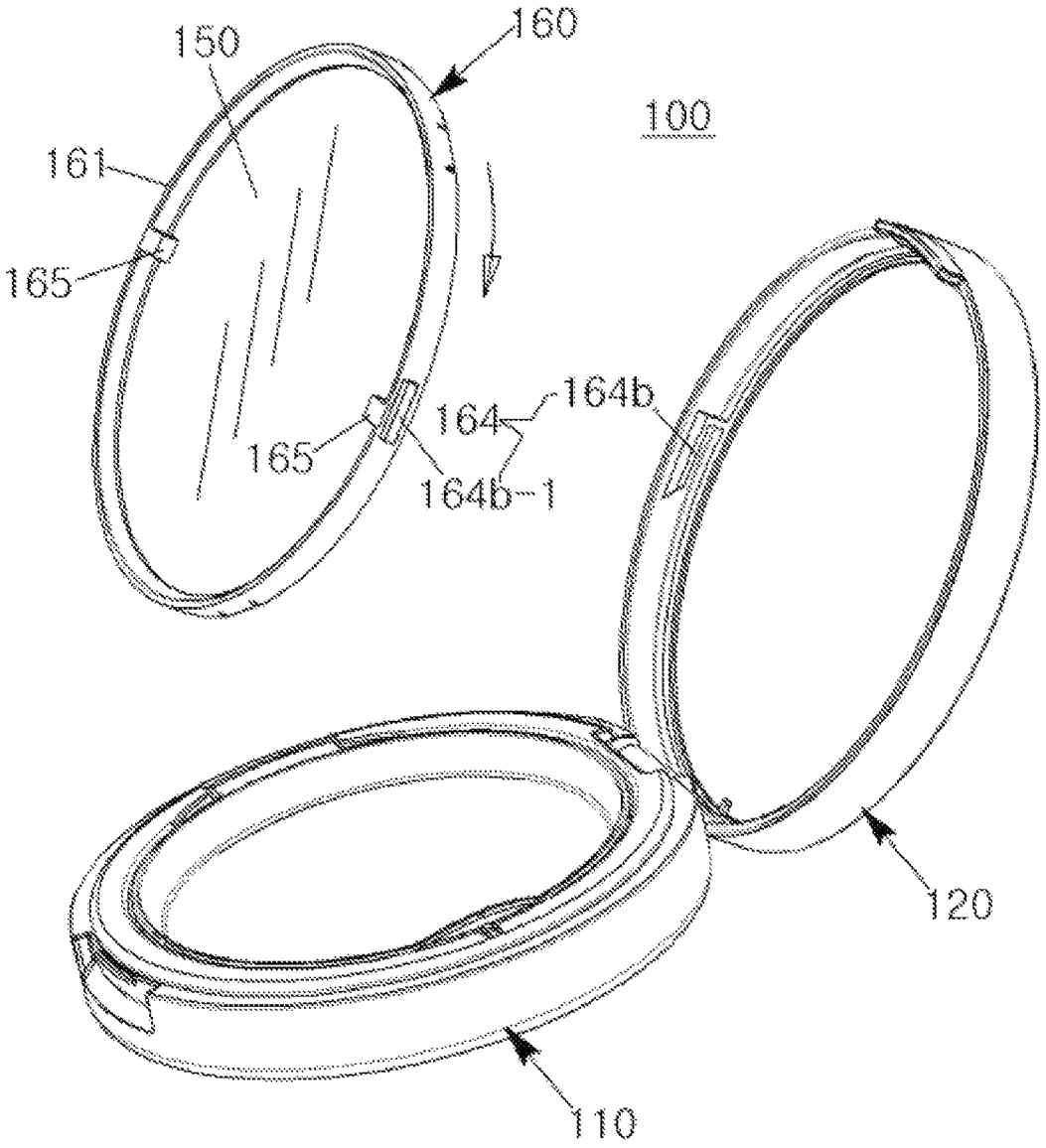
FIG. 19 is a partially exploded perspective view showing a state where the cover ring coupled to the mirror is separated from the upper container by means of rotary hooks in the eco-friendly cosmetic container according to the present invention.
Figure 20:
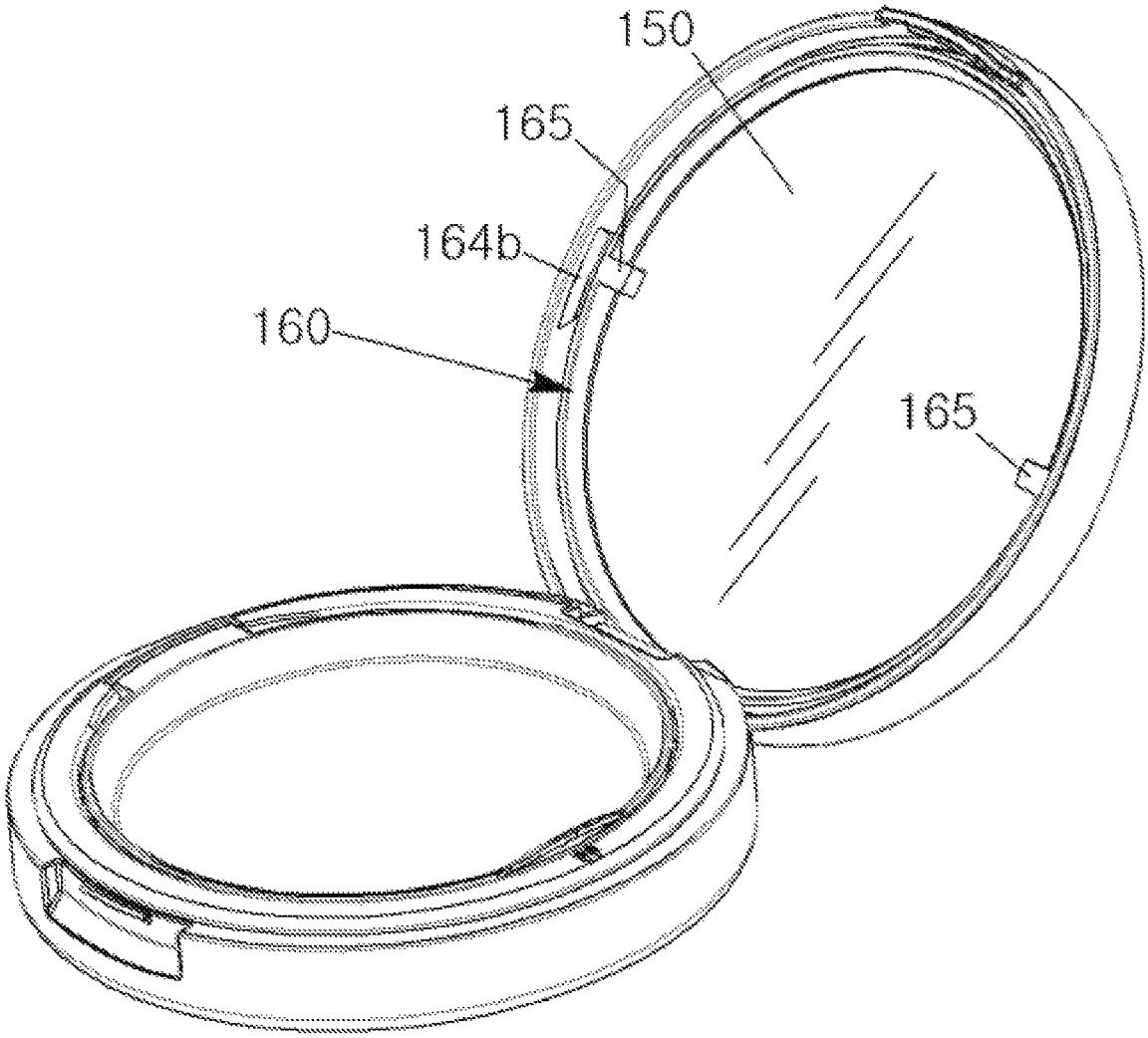
FIG. 20 is a sectional view showing a state where the cover ring coupled to the mirror is coupled to the upper container by means of rotary hook members in FIG. 19.

Further, as shown in FIGS. 19 and 20, the hook members 164 include one or more hook grooves 164*b* spaced apart from each other along the inner peripheral surface of the upper container 120 at given intervals and hook projections 164*b*-1 spaced apart from each other on the outer peripheral surface of the frame 161 of the cover ring 160 and thus locked onto the hook grooves 164*b* and released from the locked states according the rotation of the cover ring 150, so that the cover ring 160 is separably coupled to the upper container 120 by means of its rotation.

In the case where the rotation method using the hook grooves 164*b* and the hook projections 164*b*-1 of the hook members 164 is applied, the cover ring 160 is first located inside the upper container 120, places the hook projections 164*b*-1 on the hook grooves 164*b*, rotates in one direction, and finally fittedly coupled to the upper container 120. If it is desired to separate the cover ring 160 from the upper container 120, the cover ring 160 rotates in the opposite direction to one direction, and accordingly, a coupling force between the cover ring 160 and the upper container 120 is released, so that the cover ring 160 is separated from the upper container 120.

In this case, it is convenient to rotate the cover ring 160 by means of separation pieces 165, but if necessary, the cover ring 160 may rotate by using specific portions thereof, without having any separation pieces 165.

Figure 21:
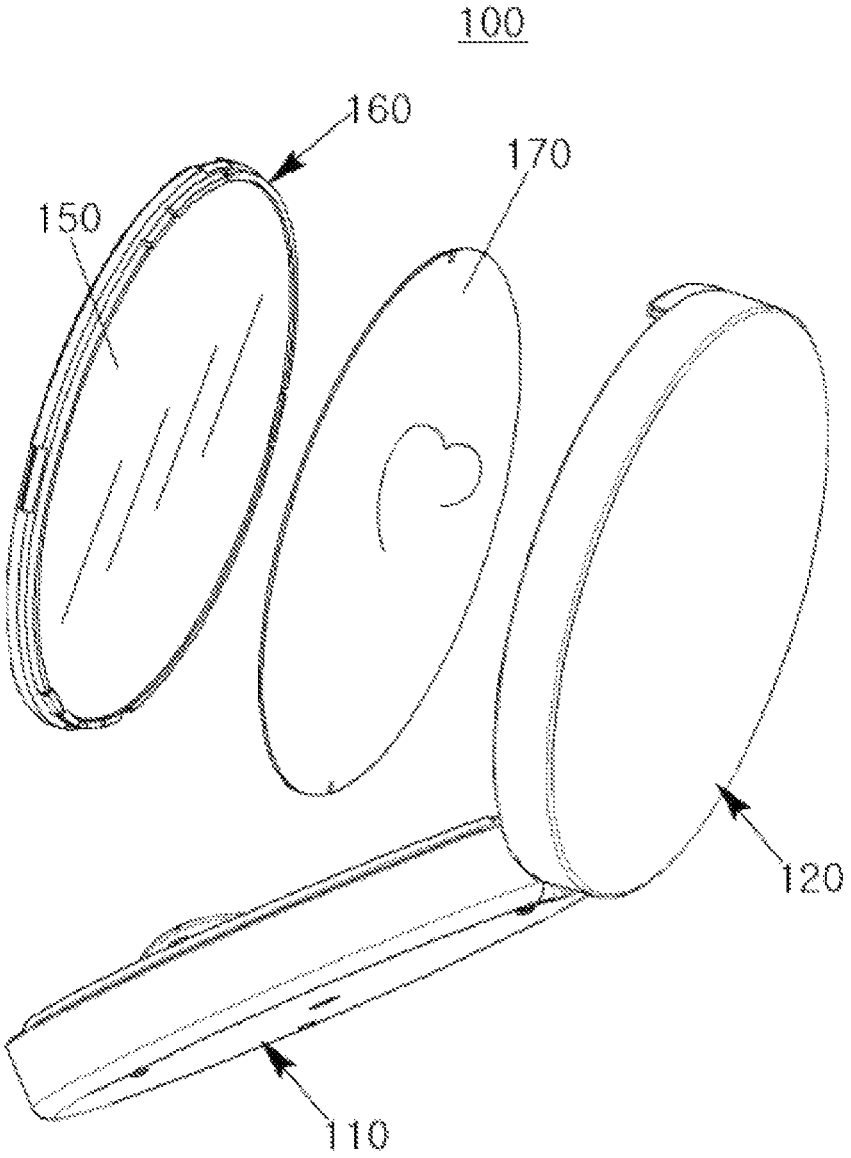
FIG. 21 is an enlarged perspective view showing a state where a nameplate is positioned between the cover ring to which the mirror is coupled and the upper container in the eco-friendly cosmetic container according to the present invention.

Further, as shown in FIG. 21, the nameplate 170 is additionally disposed between the underside of the cover ring 160 to which the mirror 150 is fixed and the inner peripheral surface of the upper container 120.

The nameplate 170 is made of various materials, such as metal, paper, film, photo, and the like and has various patterns, pictures, or prints formed thereon according to its purposes or functions.

When the cover ring 160 is separated from the upper container 120, the nameplate 170 is naturally separated from the interior of the upper container 120, so that the nameplate 170 is easily replaced with new one or separately discharged from the upper container 120.

If the nameplate 170 is disposed inside the upper container 120, further, the upper container 120 is desirably made of a transparent or semi-transparent material so that the nameplate 170 can be seen through the upper container 120.

According to the present invention, even the nameplate 170 is replaceable or separately dischargeable through the cover ring 160 from the upper container 120, without being attached to the upper container 120 by means of an adhesive, so that while the functions of the nameplate 170 are provided to the maximum, many conveniences in using the eco-friendly cosmetic container of the present invention can be provided for the user.

Under the above-mentioned configuration, the fixed and separated states of the cosmetic material accommodation dish 130 in the eco-friendly cosmetic container 100 according to the present invention will be explained.

If it is desired to fix the cosmetic material accommodation dish 130 to the lower container 110, the cosmetic material accommodation dish 130 is first seated onto the cosmetic material accommodation dish seating portion 111 of the lower container 110. As a result, the given portions of the side peripheral surface of the cosmetic material accommodation dish 130 are fixedly supported against the seating ribs 111*a* to prevent the cosmetic material accommodation dish 130 from moving to the left and right sides. In the state, the intermediate support 140 is located inside the lower container 110 in a state of allowing the outer peripheral surface 141*b* to be seated on the open top peripheral surface of the lower container 110, and further, after the elastic locking pieces 141*d* protruding from the support wall 141*c* of the holder 141 are located onto the open front surfaces of the hook grooves 112 of the lower container 110, the intermediate support 140 rotates in the locking direction (in the clockwise direction) to allow the elastic locking pieces 141*d* to be forcedly inserted and thus locked onto the locking grooves 112, so that the cosmetic material accommodation dish 130 is supportedly fixed to the interior of the lower container 110. Further, the open top end periphery of the cosmetic material accommodation dish 130 is pressurized against the cap base 141*a* of the holder 141 to prevent the cosmetic material accommodation dish 130 from moving to the left and right sides. As a result, the cosmetic material accommodation dish 130, which is seated onto the cosmetic material accommodation dish seating portion 111 of the lower container 110, is prevented from moving to every direction so that it can be stably fixed to the lower container 110. In addition, when the cap 142 is closed, the cosmetic material ejecting space 141*a*-1 of the holder 141 is blocked by means of the sealing stepped projection 142*d* to prevent the cosmetic material stored in the cosmetic material accommodation dish 130 from leaking or scattering to the outside, and contrarily, only when the cap 142 is open, the cosmetic material ejecting space 141*a*-1 is open to allow the ejection of the cosmetic material.

After the cosmetic material has been used up, if it is desired to replace the cosmetic material accommodation dish 130 with a refill cosmetic material accommodation dish or separate the cosmetic material accommodation dish 130 from the lower container 110, the intermediate support 140 being in the locked state rotates in the locking-releasing direction (in the counterclockwise direction). As a result, the elastic locking pieces 141*d* forcedly escape from the interiors of the hook grooves 112, and then, the intermediate support 140 lifts up to allow the cosmetic material accommodation dish 130 to be in a separable state. In this case, the cosmetic material accommodation dish 130 freely remains in the cosmetic material accommodation dish seating portion 111, separately from the intermediate support 140, or the side peripheral surface of the cosmetic material accommodation dish 130 comes into contact with the support ribs 141*e* of the holder 141 to allow the cosmetic material accommodation dish 130 to lift up, together with the intermediate support 140. Accordingly, the cosmetic material accommodation dish 130, which freely remains in the cosmetic material accommodation dish seating portion 111 after the separation of the intermediate support 140, is ejected from the lower housing 110, and otherwise, the cosmetic material accommodation dish 130 lifting up together with the intermediate support 140 is simply separated from the intermediate support 140 by means of the grasping spaces 141*f* of the holder 141.

The cosmetic material accommodation dish 130 according to the present invention is stably fixed to the lower container 110, without using any double-sided tape or adhesive applied in the conventional practices, and is separated from the lower container 110 by means of the simple rotation of the intermediate support 140, so that the cosmetic material accommodation dish 130 can be replaced with the refill dish or separately discharged from the lower container 110 by everybody in convenient and easy manners.

Next, the fixed and separated states of the mirror 150 in the eco-friendly cosmetic container 100 according to the present invention will be explained.

According to the present invention, the mirror 150 itself is not supportedly fixed to the interior of the upper container 120, but the mirror 150 is mounted inside the upper container 120 and thus replaceable and separately discharged with new one or from the upper container 120 through the cover ring 160. After the mirror 150 is first located on the portions of the frame 161 on which the elastic support pieces 153 are formed, the back surface of the mirror 150 is pressurized forward so that the front surface of the mirror 150 is fixedly coupled supportedly to the mirror support surface 162. Accordingly, the mirror 150 is fitted between the mirror support surface 162 and the elastic support pieces 163, and unless the mirror 150 is forcedly separated, the mirror 160 is kept in the stable coupled state to the cover ring 160. Further, the cover ring 160 to which the mirror 150 is fixed is forcedly pressurized against the upper container 120 or rotates in one direction, so that the cover ring 160 is coupled integrally to the upper container 120. In specific, as the cover ring 160 is forcedly pressurized against the upper container 120 or rotates in one direction (in the clockwise direction), the hook members 164 are fixedly coupled to one another, so that the cover ring 160 is fixedly coupled to the upper container 120.

If it is desired to replace or separately discharge the mirror 150, contrarily, an external force is applied to the frame 161 of the cover ring 160 to cause the cover ring 160 to be forcedly ejected from the upper container 120, and otherwise, the cover ring 160 rotates in the other direction (in the counterclockwise direction) to cause the cover ring 160 to be separated from the upper container 120. Next, the mirror 150 is forcedly separated from the cover ring 160 and thus replaced or separately discharged. When the cover ring 160 is separated from the upper container 120, the separation becomes convenient by using the separation pieces 165.

According to the present invention, the mirror 150 is stably fixed to the upper container 120, without using any double-sided tape or adhesive applied in the conventional practices, and is separated from the upper container 120 by means of the simple separation of the cover ring 160, so that the mirror 150 can be replaced with new one or separately discharged from the upper container 120 by everybody in convenient and easy manners.

According to the present invention, further, the configuration wherein the mirror 150 is fixedly supported against the cover ring 160 and separated from the upper container 120 by means of the cover ring 160 is adopted, it is very convenient to replace or separate the nameplate 170. To do this, the upper container 120 is made of the transparent or semi-transparent material, and after the nameplate 170 is placed between the cover ring 160 and the upper container 120, the cover ring 160 is separated from the upper container 120, thereby making possible to replace or separately discharge the nameplate 170 with new one or from the upper container 120.

According to the present invention, the eco-friendly cosmetic container 100 is configured to allow the cosmetic material accommodation dish 130, the mirror 150, and the nameplate 170, which are difficult in their replacement or separate discharge in the conventional practices, to be replaced with new ones or separately discharged by everybody in convenient and easy manners, thereby being provided as an eco-friendly product with no inconveniences in their separate discharge.

According to the present invention, the eco-friendly cosmetic container 100 is configured to allow all of the parts excepting the cosmetic material accommodation dish 130 replaceable by a refill dish to be continuously usable, except in certain cases, thereby preventing the waste of resources, minimizing the number of parts thrown away to reduce the environmental pollution caused by the waste parts, and enabling the user to buy only the part as needed to reduce his or her cosmetic product purchase cost.

As described above, the eco-friendly cosmetic container according to the present invention allows the cosmetic material accommodation dish seated onto the interior of the lower container to be stably mounted and separated onto and from the lower container by means of the rotation of the intermediate support, so that the cosmetic material accommodation dish can be separately discharged from the lower container very conveniently and easily and thus replaced with a refill dish.

Further, the eco-friendly cosmetic container according to the present invention allows the mirror disposed inside the upper container to be separably mounted on the upper container by means of the cover ring, so that if necessary, the mirror can be replaced or separately discharged very conveniently, easily and quickly.

Moreover, the eco-friendly cosmetic container according to the present invention allows the cover ring to which the mirror is fixed to be detachably mounted onto the upper container, so that the nameplate can be placed between the cover ring and the inner peripheral surface of the upper container, thereby enabling the nameplate to be replaced or separately discharged very easily.

In addition, the eco-friendly cosmetic container according to the present invention allows the cosmetic material accommodation dish that is replaced with a refill dish after the cosmetic material has been used up or the mirror to be separated from the lower container or the upper container quickly and conveniently, so that there are no difficulties in separately discharging the cosmetic material accommodation dish or the mirror, thereby enabling the cosmetic container to be provided as an eco-friendly product.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An eco-friendly cosmetic container comprising:

a lower container having a cosmetic material accommodation dish seating portion;

an upper container configured to be opened and closed with respect to the lower container by a first hinge;

a cosmetic material accommodation dish configured to be seated on the cosmetic material accommodation dish seating portion;

an intermediate support configured to be rotated with respect to the lower container to be locked into or released from the lower container over a given region thereof to separably fix the cosmetic material accommodation dish to the lower container;

a cover ring separably mounted in the upper container; and a mirror separably disposed in the cover ring, wherein the cover ring includes:

a mirror support surface defined on an inner peripheral surface of the cover ring; and one or more elastic support pieces disposed on the cover ring, the one or more elastic support pieces being spaced apart from the mirror support surface in an axial direction of the cover ring, wherein the mirror is elastically supported without any adhesive between the mirror support surface and the one or more elastic support pieces, the mirror being configured to be separated from the cover ring when the mirror is pushed toward the one or more elastic support pieces, wherein the intermediate support has one or more elastic locking pieces protruding from an outer peripheral surface thereof to be coupled to or separated from one or more locking grooves defined on an inner peripheral surface of the lower container, each locking groove being a hook groove having an open portion and a closed portion, wherein each locking groove has a reverse movement prevention projection disposed between the open portion and the closed portion of the hook groove, and each elastic locking piece has a reverse movement prevention groove configured to be interlocked with the reverse movement prevention projection to prevent the intermediate support from being reversely released from the lower container, wherein each elastic locking piece is an elongated body extending and protruding on an outer circumferential surface of a side wall of the intermediate support in a direction same as a circumferential direction of the intermediate support, wherein the elongated body has an entry portion at a front end of the elongated body, a rear end portion at a rear end of the elongated body, and an intermediate portion disposed between the entry portion and the rear end portion connecting the rear end portion to the entry portion, the elongated body having a tapering width from the rear end to the front end, such that a width of the entry portion is narrower than a width of the rear end portion, the entry portion being configured to be inserted into a corresponding locking groove at an initial entry, and wherein the reverse movement prevention groove is defined on an outer surface of the intermediate portion, such that the intermediate portion is recessed toward the outer circumferential surface with respect to the entry portion and the rear end portion, wherein, when the elongated body is inserted into the corresponding locking groove, the entry portion of the elongated body is configured to be inserted into the corresponding locking groove between the reverse movement prevention projection and the closed portion of the hook groove, the intermediate portion of the elongated body is configured to be interlocked with the reverse movement prevention projection, and the rear end portion of the elongated body is configured to be disposed at the open portion of the hook groove, wherein a locked state display portion is defined on the outer peripheral surface of the intermediate support at a position corresponding to the first hinge to notify a user of an interlocking state of the reverse movement prevention groove and the reverse movement prevention projection, wherein a portion of the side wall of the intermediate support adjacent to the entry portion and another portion of the side wall of the intermediate support adjacent to the rear end portion are partially incised, such that each elastic locking piece is configured to elastically locked onto the corresponding locking groove.

2. The eco-friendly cosmetic container according to claim 1, wherein the cosmetic material accommodation dish seating portion comprises seating ribs adapted to prevent the cosmetic material accommodation dish seated thereon from moving in a lateral direction.

3. The eco-friendly cosmetic container according to claim 2, wherein the seating ribs protrude upward from the cosmetic material accommodation dish seating portion by a given height, while being spaced apart from each other.

4. The eco-friendly cosmetic container according to claim 1, wherein the intermediate support comprises:

a holder having a cosmetic material ejecting space penetrating a bottom surface thereof to apply a cosmetic material stored in the cosmetic material accommodation dish therethrough; and a cap connected to the holder by a second hinge on one side thereof to be openable and closable with respect to the holder.

5. The eco-friendly cosmetic container according to claim 4, wherein the holder comprises:

an outer peripheral surface extending outward from a top end periphery thereof to be mounted on an open top end periphery of the lower container when the holder is mounted on the lower container;

a cap base extending inward from a bottom end periphery of the outer peripheral surface of the holder to provide the cosmetic material ejecting space; and a support wall extending downward from an outer peripheral surface of the cap base, wherein the one or more elastic locking pieces protrude from an outer peripheral surface of the support wall.

6. The eco-friendly cosmetic container according to claim 5, wherein the holder comprises support ribs extending downward from a bottom surface of the cap base to pressurize a side peripheral surface of the cosmetic material accommodation dish so that when the intermediate support lifts up from the lower container, the cosmetic material accommodation dish lifts up in a state of hanging together with the holder, while coming into close contact with the support ribs of the holder.

7. The eco-friendly cosmetic container according to claim 5, wherein the holder has grasping spaces defined to be incised on given portions of the support wall to grasp the cosmetic material accommodation dish separated from the lower container in a state of hanging together with the holder.

8. The eco-friendly cosmetic container according to claim 5, wherein the holder comprises rotation controllers disposed on top end periphery of the outer peripheral surface thereof to perform locking and releasing operations.

9. The eco-friendly cosmetic container according to claim 5, wherein an open top surface of the cosmetic material accommodation dish seated on the cosmetic material accommodation dish seating portion of the lower container is covered with the cap base of the holder having the cosmetic material ejecting space, when the intermediate support is closed, so that the cosmetic material accommodation dish is prevented from escaping upward.

10. The eco-friendly cosmetic container according to claim 4, wherein the cap, which is configured to be open and closed with respect to the holder, has:

a bottom surface on which an inwardly concave accommodation space is defined; and a sealing stepped projection protruding from an outer bottom end periphery thereof to allow the cosmetic material ejecting space defined on the bottom surface of the holder to be sealed from an outside.

11. The eco-friendly cosmetic container according to claim 1, wherein the intermediate support comprises a holder having a cosmetic material ejecting space penetrating a bottom surface thereof to apply a cosmetic material stored in the cosmetic material accommodation dish therethrough, without having a cap.

12. The eco-friendly cosmetic container according to claim 11, wherein the holder comprises rotation controllers disposed on top end periphery of the outer peripheral surface thereof to perform locking and releasing operations.

13. The eco-friendly cosmetic container according to claim 1, wherein the cover ring further comprises:

a frame open in both directions; and hook members adapted to separably mount the cover ring on the upper container.

14. The eco-friendly cosmetic container according to claim 13, wherein the cover ring comprises a separation piece adapted to perform coupling to or separating from the upper container.

15. The eco-friendly cosmetic container according to claim 13, wherein the hook members comprise:

one or more hook pieces protruding from an inner peripheral surface of the upper container at given intervals; and one or more hook projections spaced apart from one another on an outer peripheral surface of the frame of the cover ring to be locked into the one or more hook pieces, so that the cover ring is directly pressurized against the upper container and separably coupled to the upper container.

16. The eco-friendly cosmetic container according to claim 13, wherein the hook members comprise:

one or more hook grooves spaced apart from each other along an inner peripheral surface of the upper container at given intervals; and one or more hook projections spaced apart from each other on an outer peripheral surface of the frame of the cover ring to be locked into the one or more hook grooves, so that the cover ring rotates with respect to the upper container and separably coupled to the upper container.

17. The eco-friendly cosmetic container according to claim 1, wherein the upper container is made of a transparent or semi-transparent material and has a nameplate disposed therein so that the nameplate is replaced with a new one or separately discharged from the upper container by a separation of the cover ring to which the mirror is fixed.

* * * * *